US010470501B2

(12) United States Patent
Caden

(10) Patent No.: US 10,470,501 B2
(45) **Date of Patent: *Nov. 12, 2019**

(54) GARMENT FOR CONTAINING MOISTURE COMPOSITIONS

(71) Applicant: JKL IP COMPANY LLC, Sherman Oaks, CA (US)

(72) Inventor: Jodi E. Caden, Sherman Oaks, CA (US)

(73) Assignee: JKL IP Company LLC, Sherman Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/958,894

(22) Filed: Apr. 20, 2018

(65) Prior Publication Data

US 2018/0295892 A1 Oct. 18, 2018

Related U.S. Application Data

(63) Continuation-in-part of application No. 14/540,503, filed on Nov. 13, 2014, now Pat. No. 10,045,569.

(60) Provisional application No. 61/945,294, filed on Feb. 27, 2014, provisional application No. 61/903,673, filed on Nov. 13, 2013.

(51) Int. Cl.

| | |
|---|---|
| ***A41C 1/10*** | (2006.01) |
| ***A41D 1/21*** | (2018.01) |
| ***A41D 31/102*** | (2019.01) |
| ***A41D 31/12*** | (2019.01) |

(52) U.S. Cl.

CPC ..... *A41C 1/10* (2013.01); *A41D 1/21* (2018.01); *A41D 31/102* (2019.02); *A41D 31/12* (2019.02); *A41D 2400/38* (2013.01); *A41D 2500/10* (2013.01)

(58) Field of Classification Search

CPC ... A41D 1/21; A41D 1/06; A41D 1/08; A41C 1/06; A41C 1/08; A41C 1/10

USPC ..... 450/155, 156; 2/69, 227, 228, 238

See application file for complete search history.

(56) References Cited

U.S. PATENT DOCUMENTS

| | | | |
|---|---|---|---|
| 2,513,039 | A | 6/1950 | Miller |
| 2,854,006 | A | 9/1958 | Geimer |
| 4,596,253 | A | 6/1986 | Griffith |
| 4,789,372 | A | 12/1988 | Wicks |
| 5,431,030 | A | 7/1995 | Ishizaki et al. |
| 5,533,961 | A | 7/1996 | Iwata |
| 5,762,535 | A | 6/1998 | Nishiyama et al. |
| 5,787,512 | A | 8/1998 | Knox |
| 6,146,240 | A | 11/2000 | Morris |
| 6,272,888 | B1 | 8/2001 | Fujita et al. |
| 6,401,497 | B1 | 6/2002 | Nishiyama et al. |

(Continued)

*Primary Examiner* — Gloria M Hale

(74) *Attorney, Agent, or Firm* — Stetina Brunda Garred & Brucker

(57) ABSTRACT

A maternity or postpartum support-garment that includes at least one of a stretchable and/or compressive material, at least one generally cylindrical shaped upper portions, and at least one generally cylindrical shaped base portions is provided. The maternity or postpartum support garment may further include at least one ribbing sections located on at least one of the one or more generally cylindrical shaped upper portions or base portions. The at least one ribbing section may include a first level of compression. The first section may include a different level of compression than the at least one ribbing section.

20 Claims, 30 Drawing Sheets

(56) References Cited

U.S. PATENT DOCUMENTS

| | | | | |
|---|---|---|---|---|
| 6,817,034 | B2 | 11/2004 | Smilovic | |
| 7,074,204 | B2 | 7/2006 | Fujii et al. | |
| 7,559,093 | B2 | 7/2009 | Sudo et al. | |
| 7,614,256 | B2 | 11/2009 | Mitchell | |
| 7,631,366 | B2 | 12/2009 | Oyama et al. | |
| 7,631,521 | B2 | 12/2009 | Oya | |
| 7,670,205 | B2 | 3/2010 | Oyama et al. | |
| 7,677,953 | B2 | 3/2010 | Oyama et al. | |
| 7,685,651 | B2 | 3/2010 | Yoo | |
| 7,730,552 | B2 | 6/2010 | Ota et al. | |
| 7,908,670 | B2 | 3/2011 | Semba et al. | |
| 8,603,549 | B1 * | 12/2013 | Baker | A61Q 19/06 424/402 |
| 10,045,569 | B2 * | 8/2018 | Caden | A41C 1/08 |
| 2004/0049834 | A1 | 3/2004 | Stangle et al. | |
| 2007/0149093 | A1 | 6/2007 | Lutz | |
| 2008/0295217 | A1 * | 12/2008 | Hendrickson | A41D 1/21 2/69 |
| 2009/0270012 | A1 | 10/2009 | Melarti et al. | |
| 2013/0165018 | A1 * | 6/2013 | Barker | A41C 1/10 450/95 |
| 2015/0133031 | A1 * | 5/2015 | Caden | A41C 1/08 450/156 |
| 2015/0320121 | A1 * | 11/2015 | Fligel | A41C 1/10 450/155 |

* cited by examiner

BELLY BANDIT

| Product Name | Compression Level | Features/Benefits |
|---|---|---|
| Belly Boost® | 3 | Stretch and recover fabric; ultra-soft, breathable knit; side ruching; belly support |
| Flawless Belly® | 2 | Stretch and recover fabric; side ruching; belly support; lotions and creams won't seep through fabric |
| Thighs Disguise™ | 2 | Ultra-thin yet durable material; gently lifts belly; smoothes tummy, thighs, and butt; lotions and creams won't seep through fabric |
| Belly Shield® | 1 | Ultra-thin yet durable material; provides light smoothing of waist and tummy; lotions and creams won't seep through fabric |
| Bump Support™ Leggings & Capri Leggings | 2-3 | No-Show Tush™ (opaque, interlocking knit fabric); supports and smoothes; lotions and creams won't seep through fabric |
| Belly Wraps (Original, Viscose from Bamboo, Couture, B.F.F., 10th Anniversary) | 5 | Provides strong compression; slims and supports belly, waist, and hips; supports postpartum belly and back |
| Mother Tucker® Corsets | 4+ | Double-layered compression; slims and smoothes belly and waist; minimizes back bulge |
| Mother Tucker® Cincher* | 3 | Double-layered compression; slims and smoothes belly and waist; minimizes back bulge |
| Mother Tucker® Scoop Neck Tank | 3 | Soft, tubular knit; varied zones of targeted compression; smoothes & shapes belly & waist; minimizes back bulge |
| Mother Tucker® Nursing Tank | 3 | Soft, tubular knit; varied zones of targeted compression; smoothes & shapes belly & waist; minimizes back bulge |
| Mother Tucker® Shorties | 3 | Offers targeted compression; smoothes & shapes tummy, butt, and thighs |
| Mother Tucker® Leggings & Capri Leggings | 4 | Offers targeted compression; smoothes & shapes from the waist down |
| C-Section & Postpartum Recovery Undies | 4/2 | Moisture-wicking, quick dry fabric; dual-zoned compression |
| C-Section Briefs* | 2 | Moisture-wicking, quick dry fabric; light to moderate compression |
| B.D.A. Before During After™ Maternity Tank* | 2 | Stretch and recover fabric; ultra-soft, breathable knit; side ruching; lotions and creams won't seep through fabric |
| B.D.A. Before During After™ Leggings* | 1 | Seamless, ageless design; ultra-soft, breathable knit; supports belly |
| Yoga Maternity Tank* | 2 | Stretch and recover, moisture-wicking, and quick dry fabric; side ruching; supports belly |
| Yoga Pants* & Capri Pants* | 2 | Ultra-soft, moisture-wicking, and quick dry fabric; supports belly |

* Coming Soon

FIG. 33

GARMENT FOR CONTAINING MOISTURE COMPOSITIONS

CROSS-REFERENCE TO RELATED APPLICATIONS

This application is a continuation-in-part of U.S. patent application Ser. No. 14/540,503, filed Nov. 13, 2014 and issued on Aug. 14, 2018 as U.S. Pat. No. 10,045,569, which claims priority to U.S. Provisional Application No. 61/945,294, filed Feb. 27, 2014, and U.S. Provisional Application No. 61/903,673, filed Nov. 13, 2013, all of which are incorporated by reference herein in their entirety and for all purposes.

TECHNICAL FIELD

The present invention pertains generally to apparel, and more particularly to garments with stretchable and/or compressive features that may be worn alone or underneath or over other garments.

BACKGROUND

It is not uncommon for a woman or a man to feel self-conscious of his or her body. During periods in their lives, men and women may undergo drastic bodily changes. For example, during a stressful period or a period of dieting and exercise, a person may gain or lose extreme amounts of weight. Weight gain may lead to unsightly lumps, bumps, and stretching of skin, which may even be visible to others if the person is wearing tight or clingy garments. In addition, individuals undergoing particular surgeries, such as bariatric surgery, may experience rapid weight loss. Such rapid weight loss may lead to sagging skin.

Further, the shape of a woman's body also changes dramatically during and after pregnancy and considerable time and effort may be required to return to pre-pregnancy body measurements. In particular, the pregnant woman's belly goes through several phases, expanding and retracting over a period of time, which is relatively short in comparison to some non-pregnancy related weight gains and losses. The woman's skin, in particular around the belly area, stretches during pregnancy often leaving unfavorable marks or lines, more commonly known as stretch marks. During or after pregnancy, a woman may also notice weight gain, stretch marks, sagging skin, and/or a dimpled or lumpy appearance in other areas of her body, such as her buttocks, hips, and thighs.

Therefore, many men and women seek to reduce the appearance of sagging skin, dimples, and/or lumps, and may also desire additional coverage of their bodies. In addition, many people use skin products to prevent and reduce these stretch marks but are limited by when these types of products can be applied. Currently available garments can rub against the skin, causing skin products to dissipate from the area on which they were applied, reducing the effectiveness of the product. Additionally, many of these skin products contain ingredients that can seep through, deteriorate, or discolor garments, such as tops, undergarments, bottoms, accessories, such as wraps worn around the belly during or post-pregnancy or after surgeries, etc. Thus, people are limited to using these skin products at home or in private where they can be nude.

During these dramatic changes to a woman's or a man's body, traditional garments, such as tops, bottoms, undergarments, and/or any accessories may not provide total coverage of the skin of the user. For example, a woman's growing pregnant belly may lift a garment worn on the top of her belly, thereby exposing the skin between the bottom of the garment worn on the top and the garment worn on the bottom of her torso. Also, as the pregnant belly grows, or as additional weight is added to the torso region, the belly is pulled downward, which can cause pain or discomfort for the person, especially in his or her lower back.

Thus, there is a need for addressing or ameliorating one or more of the disadvantages associated with at least one of the bodily changes of a user, the dissipation of skin products, lumpy or dimpled appearance of a user's body, and/or a lack of coverage or support for a belly of a user (e.g., a pregnant woman's belly).

SUMMARY

The present invention meets one or more of the above needs by the improved devices, systems, and methods described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The disclosures of all articles and references, including patent applications and publications, are incorporated by reference for all purposes. Other combinations are also possible as will be gleaned from the following claims, which are also hereby incorporated by reference into this written description.

A maternity or postpartum support garment for the body of a wearer is provided. The maternity or postpartum support garment may include at least one stretchable and/or compressive material, at least one generally cylindrical shaped upper portions, and at least one generally cylindrical shaped base portions. The maternity or postpartum support garment may further include at least one ribbing sections located on at least one of the one or more generally cylindrical shaped upper portions or base portions. The at least one ribbing section may include a first level of compression. The front portion of the maternity or postpartum support garment may include a first section without the at least one ribbing section. The first section may include a different level of compression than the at least one ribbing section.

In some embodiments, the at least one ribbing sections may cover a part of at least one of a front portion, a side portion, and a back portion of the body of the wearer. The maternity or postpartum support garment may be configured to cover at least a part of at least one of a front portion, a side portion, and a back portion of the body of the wearer.

In some embodiments, the garment may confine one or more skin products that are applied to an area of skin on a user's body, such as chest, hips, buttocks, legs, etc. In some embodiments, the garment may protect other garments from contacting the one or more skin products on a user's body.

It is thus among the objects of the invention to provide a garment that extends the use of skin products, protects traditional garments or does not allow skin products to seep through invention, provides some lift and support to the weight of a wearer's belly and/or the back of the wearer, and/or provides additional coverage of skin as an extension for tops, such as blouses or shirts. This and other objects, advantages, and features of the invention will be apparent from the following description of a preferred embodiment, considered along with the accompanying drawings.

DESCRIPTION OF THE DRAWINGS

FIG. 33 illustrates tabular examples of some exemplary Belly Bandit products, according to exemplary embodiments of the present invention.

DETAILED DESCRIPTION

Figure 1:
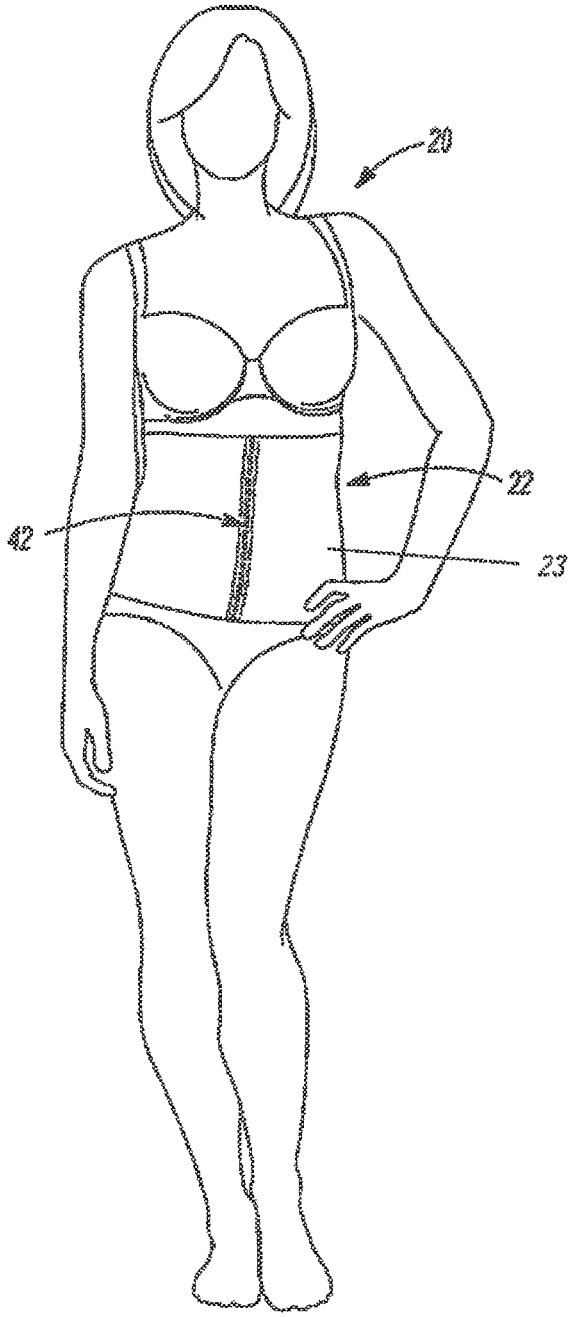
FIG. 1 illustrates a garment, such as a band, worn around the torso of a person, according to exemplary embodiments of the present invention.

The below described figures illustrate the described invention and method of use in at least one of its preferred, best mode embodiment, which is further defined in detail in the following description. Those having ordinary skill in the art may be able to make alterations and modifications to what is described herein without departing from its spirit and scope. While this invention is susceptible to different embodiments in different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

In the following description and in the figures, like elements are identified with like reference numerals. The use of "e.g.," "etc.," and "or" indicates non-exclusive alternatives without limitation, unless otherwise noted. The use of "including" or "includes" means "including, but not limited to," or "includes, but not limited to," unless otherwise noted.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

In addition, while the teachings herein may include reference to a woman and/or a pregnant belly, the teachings herein are not limited to women or for use during pregnancy or immediately after pregnancy. These teachings envision use by both men and women who are not pregnant and may require additional support for the weight of his or her belly; desire smoothing and/or additional coverage; use skin creams, gels or lotions; or any combination thereof. The garment may include either one or a combination of tops, bottoms, undergarments, and accessories. If the garment is an undergarment it may be a bra, vest, temple garment, nursing bra, nursing tank top, sports bra, swimwear, spank, lingerie, bandeau, etc. If the garment is a top, it may be any conventional garment worn on at least the top of a wearer, such as a shirt, tank top, t-shirts, rompers, coats, etc. If the garment is a bottom, it may be any conventional garment worn on at least the bottom of a wearer, such as capris, shorts, hot pants, pants, trousers, denims, etc. If the garment is an accessory, it may be any accessory, such as a waist band, belt, hat, tie, etc. Any other garment or accessory, such as tights, leggings, girdles, or any of the products sold by Belly Bandit® are all within the scope of this invention. In some embodiments, the garment may be any garment with compression levels, features, and benefits as described in the exemplary table of products sold Belly Bandit® as illustrated in FIG. 33.

The teachings herein make advantageous use of apparel. The apparel may include garments with stretchable and/or compressive features, which can be worn in such a way as to confine skin products to the body of a user, such as torso, legs, hips, buttocks, or combination thereof, of a person (e.g., a pregnant woman), prevent applied skin products from seeping through and/or guard garments worn over it from coming in contact with the applied skin products. The undergarment with stretchable and/or compressive features may also include design elements to provide gentle lift and/or support for the weight of a person's belly; to provide light compression to the torso, hips, buttocks, or thighs; to provide a smoother appearance to skin in the torso, hips, buttocks, thighs; or combination thereof. The undergarment with stretchable and/or compressive feature may further act as a shirt extension, providing additional coverage of exposed skin that shorter or traditional tops, such as shirts or blouses, cannot. The garment may have at least one of a front portion, side portion, and back portion. It may also have an upper portion or a base portion. The upper portion is any portion above the generally middle portion of the garment and the base portion may be any portion below the generally middle portion of the garment. Base portion and bottom portion of a garment are used interchangeably. Any, all, or a combination of the features disclosed herein is contemplated to be within the scope of the teachings. For example, features, characteristics, uses, etc. of a garment disclosed in the detailed description below or a particular detailed description of a figure may also be present in other garments described in the detailed description of other figures.

Figure 32D:
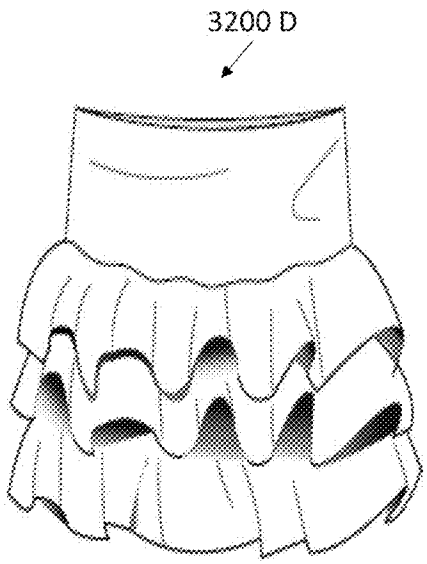
FIGS. 32A-32R illustrate exemplary garment extenders, such as shirt extenders, according to exemplary embodiment of the present invention.
Figure 32C:
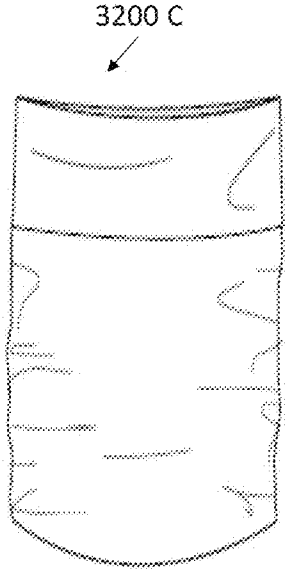
Figure 32B:
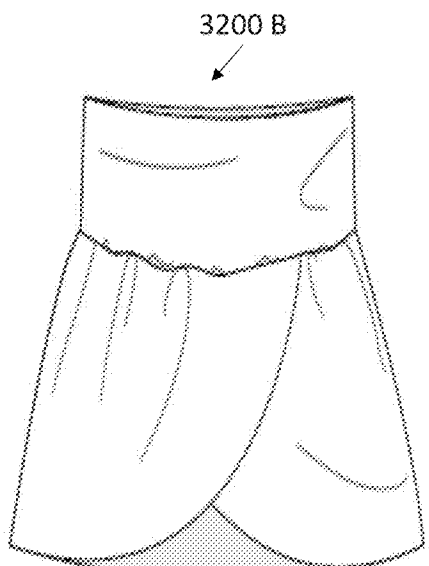
Figure 32A:
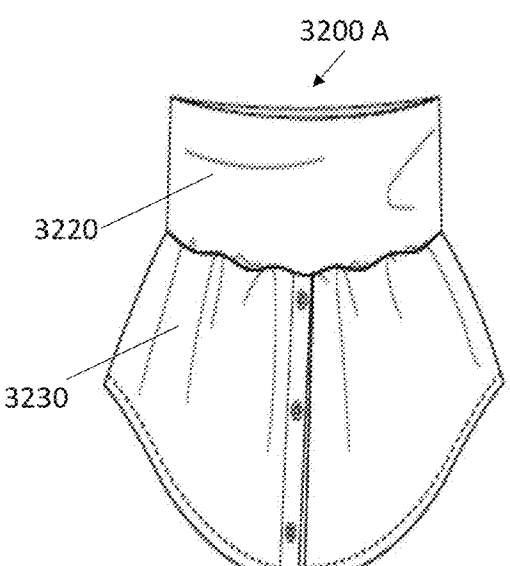
Figure 32E:
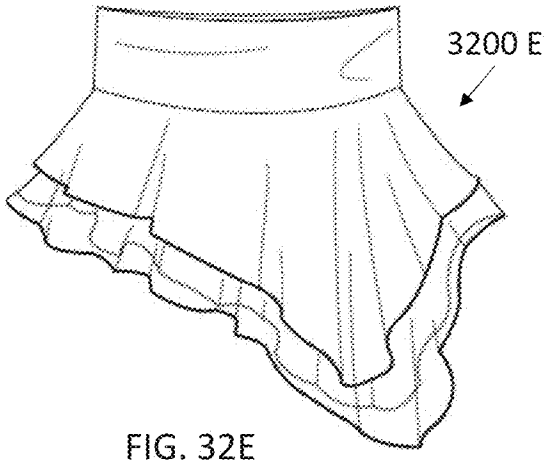
Figure 32F:
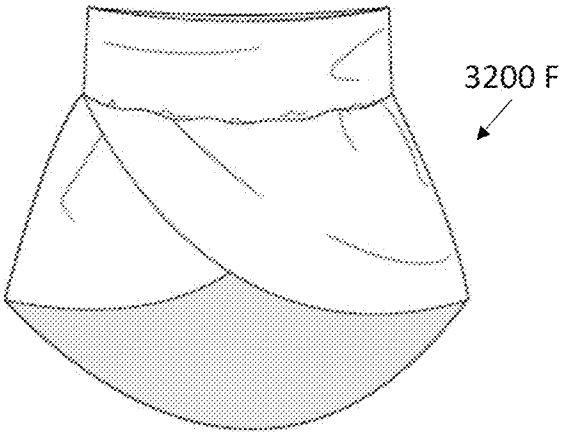
Figure 32G:
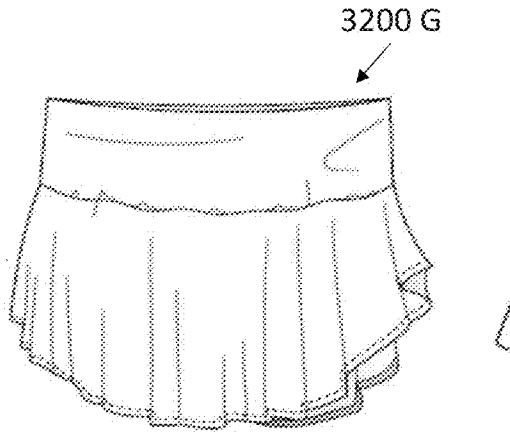
Figure 32H:
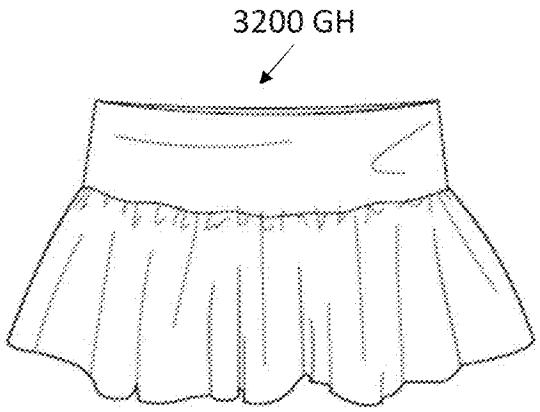
Figure 32I:
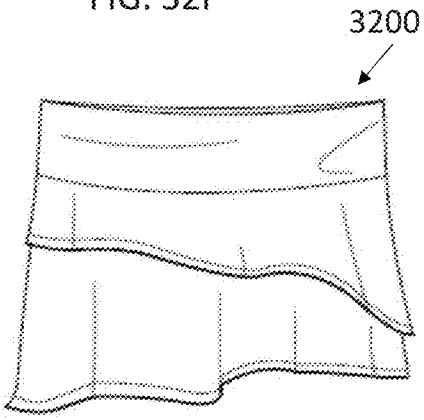
Figure 32M:
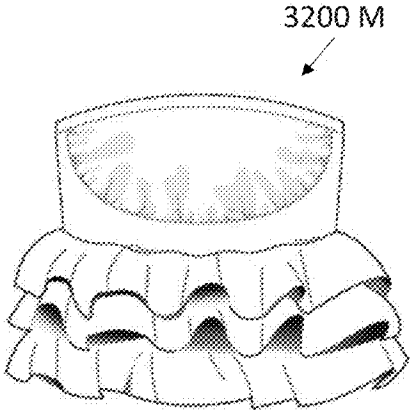
Figure 32L:
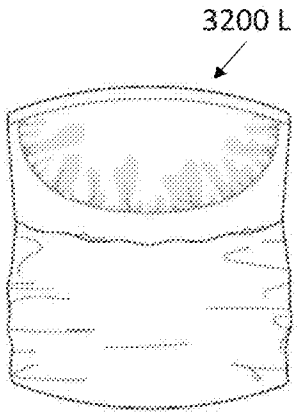
Figure 32K:
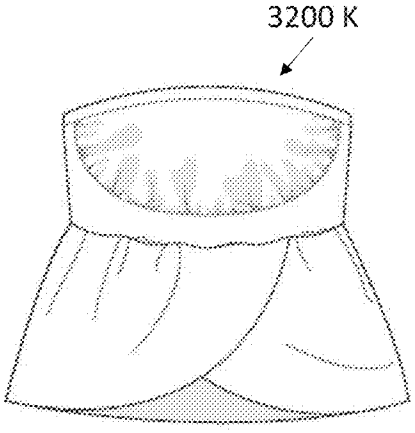
Figure 32J:
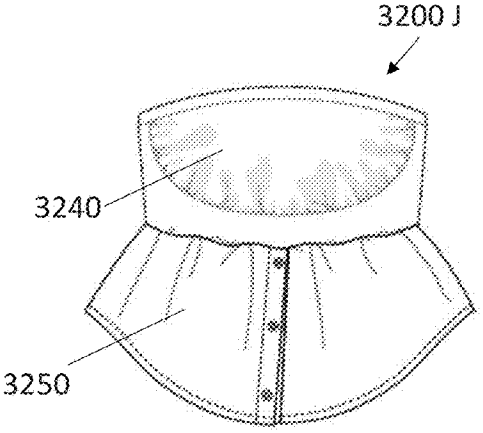
Figure 32P:
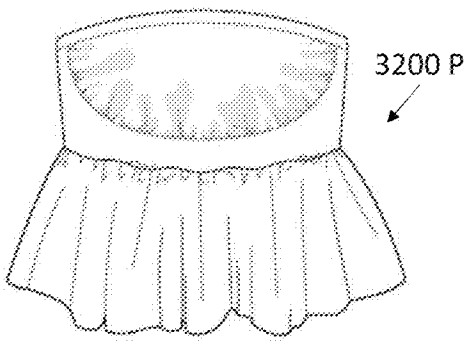
Figure 32R:
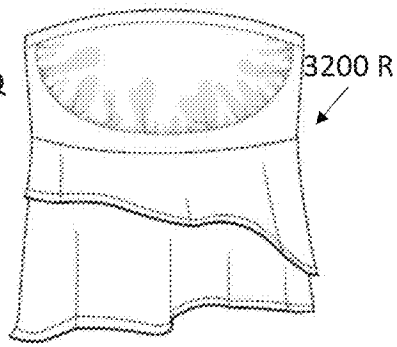
Figure 32Q:
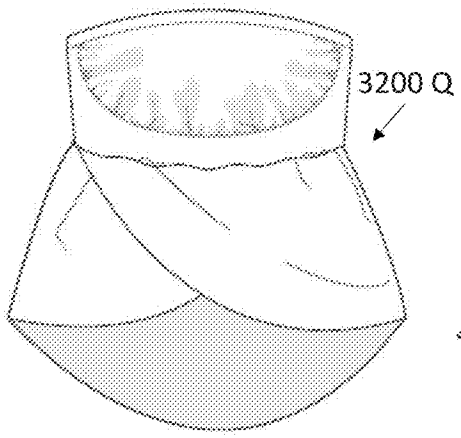
Figure 32O:
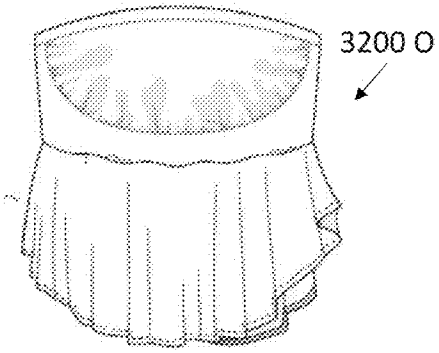
Figure 32N:
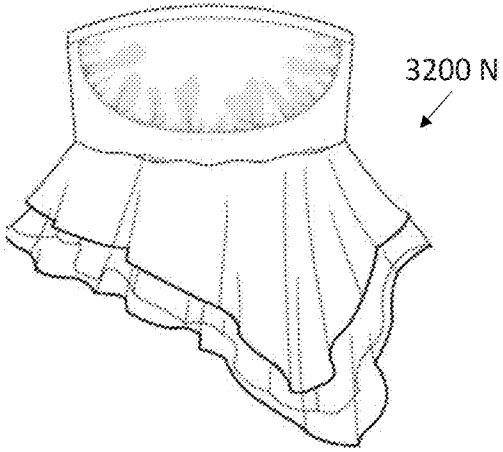

The present teachings include a garment to be worn around a portion of the torso, hips, buttocks, thighs, or combination thereof of a person (e.g., a pregnant woman, a woman post-pregnancy, a person undergoing bodily changes such as weight loss or gain, a person desiring additional support and/or compression for his or her body, and the like). Preferably, the garment is a flexible garment with sufficient elasticity to stretch over parts of the wearer's body such as the torso (e.g., a growing pregnant belly). The garment may be of sufficient dimensions to provide coverage of a portion or all of a person's torso, such as a protruding belly. The garment may also be of sufficient dimensions to provide coverage for an area below the belly, such as a person's waist, hips, buttocks, portion of his or her legs, or combination thereof. The garment, as described herein, contemplates different features, all of which, alone or in combination, are within the scope of the teachings. The garment may have features, such as a portion of additional material to serve as a garment extender as illustrated in FIGS. 32A-32R to provide additional coverage to the belly portion, hips, thighs, buttocks, or combination thereof. In some embodiments, the garment extender, such as 3200A-3200R, may be at least substantially free of any capability of holding up a garment worn on the lower half of the body. In other embodiments, the garment extender, such as 3200A-3200R, may have stretchable and/or compressive features 3220 that may provide compression and/or support to at least one of a wearer's belly, back, buttocks, etc. Stretchable and/or compressive feature 3220 may be present in any garment extenders such as 3200A-3200R and may have characteristics as described in any embodiments. Stretchable and/or compressive feature 3220 may be capable of expanding and/or contracting with varying sizes of the wearer's belly. The garment extender, such as 3200A-3200R, may have extender portions 3230, of varying lengths and size, including but not limited as illustrated in FIGS. 3200A-3200R. The extender portion 3230 can be made of a different material as the rest of the garment extender 3200A-3200R and/or the garment to which it is to be attached. The garment extender 3200A-3200R may be capable of being attached to any other garment using any attachment mechanisms, such as Velcro®, zippers, buttons, snaps, etc. The garment extenders 3200A-3200R may be capable of supporting the wearer's body parts. The garment extenders 3200A-3200R may be capable of also holding other garments in place. The garment may have additional material joining the front and rear of the garment with openings for accommodating and/or providing coverage for a person's hips, thighs, and buttocks. The garment may be of sufficient dimensions to provide coverage above a person's belly (e.g., a protruding belly, such as a pregnant belly), including an area of the person's ribcage, a person's chest, above and below the person's neck, etc. The garment may provide partial or full coverage of a woman's breasts, which may also include partial or full support to the woman's breasts (e.g., with one or more of built-in cups, ribbing, underwires, and the like). Any embodiment of the garment may also have at least one attachment means, such as one or more straps, Velcro®, snaps, buttons, zippers, etc., to attach to a woman's undergarment, such as a bra or panties (or vice versa) or to be worn on a person's shoulders or around his or her neck to provide additional support to the weight of the person's belly and back and to assist in holding the garment in the proper position. These attachment means may be adjustable in length, removable, repositionable, convertible, or combination thereof.

The garment may be of any length/height, shape, and size. The height of the garment may be constant around the entire band. The height may vary at different points of the garment (e.g., greater height along the portion that fits over the belly and lesser height in the area that covers the person's back). Other features of the garment may alter the height at different points along the band. For example, the garment may be a generally uniform height all around but adding one or more ruching sections may shorten the height of the garment in a particular area. When the one or more ruching sections are stretched vertically, the garment may again be a more uniform height. The garment may have generally straight and/or linear edges at the top edge of the band and/or bottom edge of the band. The edges of the garment may have generally curved segments, linear segments, scalloping, lace, decorative shapes or cutouts, or combination thereof. For example, the garment may have a generally convex arcuate segment at the top edge in the front to cover the top of the belly, or the garment may have one or more generally concave arcuate segments at the top edge to be positioned below and accommodate the shape of a person's chest (e.g., a woman's breasts), or to cover the breasts The garment may have one or more generally convex or generally concave arcuate segments at the bottom edge located on the base portion of the garment for more or less length in particular areas of the garment (e.g., to provide additional length in the front and/or rear for more coverage if the person lifts his or her arms, which raises his or her shirt, or to keep up with fashion trends such as more length in the rear to provide coverage of the person's buttocks). The bottom edge may generally flare out, such as to provide coverage but not compression to lower areas. The bottom edge may instead include material or fabric joining the front and rear of the garment with two openings to accommodate the woman's legs. The edge of each opening may be generally uniform around the woman's leg (e.g., the same height around her leg) or the edge may vary depending on the cut (e.g., cut higher in the front than in the rear to expose part of the front of the thigh but cover the buttocks). Additional height/length is within the scope of the teachings for garments with a bottom featuring two openings or extended cylindrical portions to accommodate covering each of a woman's legs. For example, the garment may extend downward to form shorts or leggings having two leg portions, wherein each leg portion may encircle at least a portion of the person's thigh or the entire leg. The garment may provide full or partial coverage of the person's buttocks, hips, legs, or combination thereof. The cut of the openings of the base portion may resemble briefs, a thong, boy shorts, shorts covering the upper thigh, shorts extending to the mid-thigh, shorts extending to the knee, or of a length that is capri length, extending to the ankle, or the full leg. In other words, the garment may comprise a band with features of a conventional bottom garment at its bottom. In other embodiments, the garment may comprise a band with features of a conventional top garment at its top. In other embodiments, the garment may have no band portion and just be a convention top garment or a bottom garment.

The garment preferably has a size/circumference that will accommodate a person of a designated size range. For example, the garment may accommodate a pregnant woman and/or a woman post-pregnancy seeking to return to her pre-pregnancy measurements. The garment may accommodate a person who is not pregnant or was not pregnant recently. Preferably, the band/garment is a generally cylindrical shape. However, the garment is not limited to such a shape. The garment may have a generally cylindrical shape covering at least a portion of the person's torso and may have at least one fabric joining the front and rear of the garment and forming two openings toward the base portion of the garment to accommodate a person's legs and provide coverage to the person's buttocks, hips, thighs, legs, or combination thereof. It may also have portions that accommodate the various upper body parts of a user, such as hands, and neck. The portions of the garment encircling the person's legs, arms, or neck may also be generally cylindrical to provide additional coverage to at least a portion of the person's legs, neck, arms, etc.

The circumference of the torso portion of the garment may be of a size as required by the user. When stretched horizontally, the circumference may increase by about 1.1× or more, about 1.25× or more, about 1.5× or more, about 2× or more, or even about 3× or more. The circumference may increase by about 10× or less, about 7× or less, about 5× or less, about 4× or less, or even about 3.5× or less. The circumference along the entire generally cylindrical garment may be generally constant. The circumference along the entire generally cylindrical garment may also vary. The circumference at the upper portion of the generally cylindrical garment may be greater than, less than, or approximately equal to the circumference at the base of the garment. The circumference of various cylindrically (or other) shaped components on the garment may have different circumferences from each other or have the same circumference as each other. The garment may have a greater circumference in the area that covers a belly portion, such as a growing pregnant belly. The garment may have a different circumference at a particular location of the garment from the circumference at the upper portion of the garment, the base portion of the garment, or both. The circumference at the base portion of the garment may be greater than the circumference at the upper portion the garment or vice versa. The circumference of the upper portion or the base portion of the garment may also be different to the circumference at the ribbing sections. The garment may increase or decrease in circumference as it approaches the base of the garment located on the base portion of the garment (e.g., the material may extend from the ribbing section with a gradually increasing circumference it approaches the bottom edge of the garment or may flare out). To provide additional support to the body, such as a belly, and to remain in proper position on the person's body, the parts of the garment with ruching sections may have a smaller circumference than the circumference of the top edge and/or the bottom edge of the garment.

Figure 13:
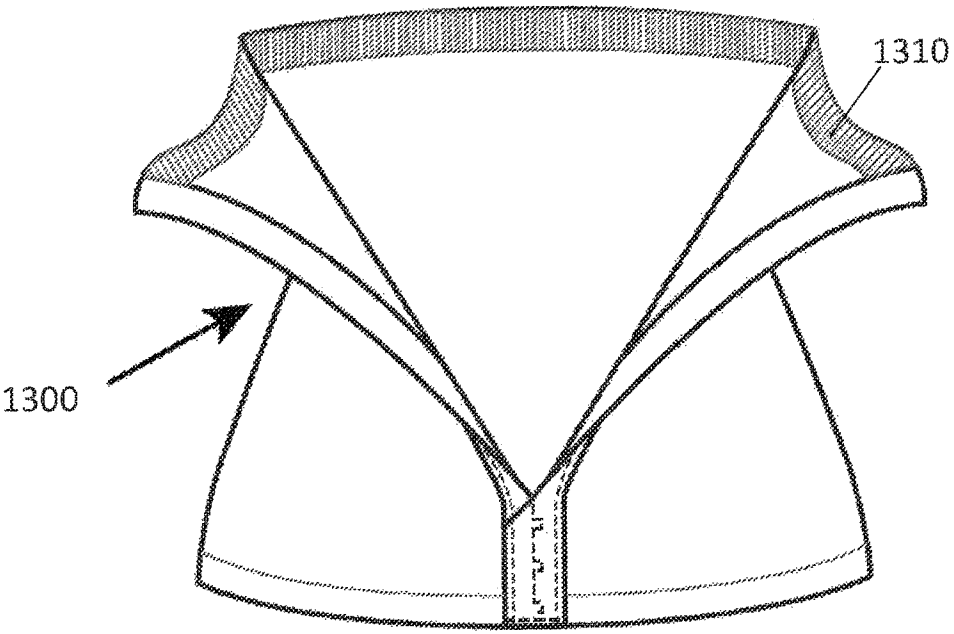
FIG. 13 illustrates a garment with ribbing located in its interior portion, according to exemplary embodiment of the present invention.

The garment may have one or more ribbing sections. Preferably, the garment has ribbing that extends at least partially around the circumference of the garment. The ribbing section may be located at the front, side, and/or back of the garment. In some embodiments, it may extend around the entire circumference of at least one cylindrical (or other) shaped portions of the garment or the entire garment itself. The ribbing is may be located in the bottom, upper, and/or middle portion of the garment. It may also be located under the belly (e.g., the protruding portion of a pregnant belly) to provide gentle lift and/or support. In some embodiments, the ribbing section is located in the bottom third of the garment. The ribbing section may have any desirable height, such as about ½ inch to about 8 inches. In some embodiments, more preferably about 1 inch to about 4 inches around the garment. The one or more ribbing sections may comprise a plurality of vertical ribs, one or more horizontal ribs, or combination thereof. The ribs may be of any width. The ribbing section may have a thickness that is generally greater than the thickness of the other portions of the garment, less than the thickness of the other portions of the garment, approximately equal to the thickness of the other portions of the garment, or combination thereof. The ribs may be located on the inside of the garment, as illustrated by ribbing 1310 in garment 1300 shown in FIG. 13, contacting the skin; on the outside of the garment; or both. The thickness of the one or more ribbing sections and location of the ribbing (e.g., on the inside, outside, or both) may be dependent upon the amount of support desired for the person's body, such as a protruding portion of the person's belly.

The garment may be made with ruching. The ruching may be located on the rear side of the garment. This ruching may allow the garment to expand vertically in the front, where weight is carried by the person (e.g., a person's belly or as a woman's pregnant belly grows), while remaining in place lower on the person's back for comfort and support. It can also allow the garment to expand in the in any direction. It can also be located on the front, side, and/or the back portion of the garment and allow the garment to expand in the portion in which it is located. The garment may have more than one section of ruching (e.g., there may be double ruching, triple ruching, or more). The ruching may be of any size and shape. For example, it may have a size of about 1 inch to about 18 inches in length, and more preferably about 6 inches to about 12 inches in length. Each ruching section may run the entire length of the garment. Each ruching section may begin at or near the top edge and run to an area around the bottom of the person's torso (e.g., ruching stopping before reaching the woman's buttocks and/or the leg portion of an embodiment of the garment). The ruching may begin at the top edge of the garment or slightly below the top edge (e.g., below a hem at the top of the garment) and run downward to the ribbing section. The ruching sections may be located on opposing sides of the generally cylindrical garment (i.e., at the endpoints of the diameter). When the garment is worn, the ruching segments may be located on the garment's front, sides, and/or on the back portions. The ruching sections may be located on the rear side of the garment. The ruching sections may be located about 1 inch apart or more, about 3 inches apart or more, or about 5 inches apart or more. The ruching sections may be located about 18 inches apart or less, about 14 inches apart or less, or about 12 inches apart or less.

The garment may be made of any one or combination of materials. The garment may be made of multiple fabrics attached together using any attachment mechanisms, such as sewing, Velcro, buttons, snaps, zippers, or any other means. For example, the garment preferably can be expanded and stretched to be firmly but comfortably worn around the torso of a person. To provide light compression and support for the belly and/or to hold in moisture, such as lotions, the fabric of the garment may have a weight of about 1.5 oz/yd$^2$ or greater, and more preferably about 4 oz/yd$^2$ or greater. On a scale of 1-5, the garment may comprise fabrics with compression ranging from 1-5 in different location. In some embodiments, the fabric has a weight of 12 oz/yd$^2$ or less, and more preferably about 10 oz/yd$^2$ or less. The garment may comprise a smooth knit fabric. The fabric may be a woven material. The fabric may be a non-woven material. The fabric may be a tubular knit. The garment may be made of a breathable fabric, stretchable fabric, compression fabric, flexible fabric, elastic fabric, or combination thereof. The garment's fabrics may comprise any combination of polyester, polyamide such as nylon, elastane/spandex, polyamide, elastane, polyester, power mesh, Flexsil® Silver Yarn, cotton, bamboo, modal, rayon, lyocell such as Tencel®, other man-made materials, the like, or combination thereof. The garment is preferably a breathable knit fabric, such as nylon or spandex (e.g., Lycra®). The garment fabric's composition may include nylon, polyester, or a blend thereof present in an amount from about 20% to about 99%, or from about 75% to about 90%. Spandex may be present in an amount from about 0% to about 40% of the garment composition, or about 10% to about 20%. The garment composition may also include cotton, bamboo, modal, rayon, Tencel®, polyester, nylon, or a blend of two or more thereof in an amount of about 2% to about 50%. Benefits of the fabric disclosed herein include, but are not limited to, being easy to clean and being resistant to fungi, molds, mildew, and chemicals.

The garment may comprise fabrics that are made of a moisture locking material. This moisture locking material may be the sole material of the garment, or a lining in the interior of the generally cylindrical garment (e.g., the band) and may contact the skin to confine the skin products to the torso or the desired areas of the body. The moisture locking material may be part of or integrated into the knit fabric. The moisture locking material may also keep external moisture out and away from the covered skin of the user. The moisture locking components, such as nylon, polyester, and other fibers such as rayon, bamboo, Tencel®, and the like, allow moisturizers or other products to seep into the skin and opposed to being absorbed by the garment, or seeping through the garment. Moisturizers or other products include but are not limited to lotions, creams, gels, cleansers, scrubs, butters, oils, jellies, emollients, and humectants, or any combination thereof. Moisture locking components also allow the garment to be easily cleaned to remove residual moisturizer that was applied to the person's skin.

In some embodiments, the garment may comprise a fabric that is made of a moisture wicking material to pull moisture such as sweat and perspiration away from the person's skin. This may help keep the person cool in hot or humid conditions, or it may help keep the person warm in cool temperatures. A composition of about 20% or more of polyester, nylon, or any yarns with wicking properties, including derivative yarns made from a blend of polyester and/or nylon, or any yarns treated to have wicking properties may be used to achieve results with or without spandex. The garment may also include fabrics with quick drying capabilities. The quick dry components, such as nylon or other fiber contents, allow the person to feel comfortable wearing the garment all day. If a garment with moisture locking material also has moisture wicking, and/or quick dry components, the wearer can benefit from all capabilities.

The garment may be a seamless garment. The garment may have one or more seams. The garment may include one or more hems (e.g., a hem at the top edge of the garment and/or a hem at the bottom edge of the garment to reduce the risk of the edges of the garment fraying). The garment may be of a single material. The garment may be formed from a single piece of fabric. The garment may be formed from multiple pieces of fabric. The garment may comprise panels of different materials joined at the one or more seams (e.g., one elastic, stretchable material for the portion of the garment above the one or more ribs, and another material below the ribbing section that serves as a shirt extension; or one material for the area of the garment contacting the user and another material on the outside of the garment). The garment (e.g., the band) may be secured around the person's torso with a fastener (e.g., Velcro®, clasps, snaps, buttons, zippers, hook and eye fasteners, the like, or combination thereof). The garment may have elastic, ribbing, an anti-slip or tacky substance (e.g., silicone band and/or lining), or other feature or combination of features at the top of the band, at the ribbing sections, along a portion or all of one or more sides of the garment, and/or at the bottom of the garment to hold the garment in place while the person is wearing it. The garment or portions of the garment may be any color or colors. Including basic colors like black, nude, gray, white, and the like, or more vibrant colors. The garment may be a solid color. The garment may have a pattern (e.g., striped, checkered, seasonal, tie dye, flowered, and the like). Different colors or patterns may be used in different areas of the garment. For example, a top portion (e.g., above the ribbing section) may be one color, such as nude, while the base portion (e.g., the portion below the ribbing section serving as a shirt extender) may be a different color to match a particular outfit or add further style to the woman's ensemble. The garment may include one or more textured portions on the inner side (e.g., against the user), on the outside (e.g., away from the user). The textured portion may be for decoration, may hold the garment in place on the user, may hold the traditional garment top in place (e.g., resisting movement through increased friction between materials), or combination thereof.

The garment, or at least a portion of the garment, may be of a stretchable and/or compressive material that can be worn throughout the different stages of a person's weight gain or loss. For example, the garment may be worn before, during, and/or after pregnancy. The garment may be worn by someone undergoing weight loss, such as through diet and exercise or surgery, such as bariatric surgery. A single garment may be worn during most stages or every stage of the person's bodily changes, such as during a woman's pregnancy or following a surgery. A person may instead wear a different garment during the stages. For example, a woman may wear a different garment during the stages of her pregnancy (e.g., a larger garment as she progresses in her pregnancy, or a smaller garment after the baby is born). The garment may be one-size-fits-all. The garment may be offered to the consumer in varying sizes (e.g., sizes designated by Small, Medium, Large, etc., or based on a person's specific measurements), which may be helpful as the person's body changes (e.g., as the person loses or gains weight, as a woman progresses in her pregnancy (e.g., a size Small while in the first trimester and a larger size while in the third trimester)). The sizing may also be determined by the size of the belly, for example based on the number of babies a pregnant woman is carrying (e.g., single child or multiples, such as twins), or other factors. The garment may also be worn post-pregnancy for slight compression, smoothing, and for holding lotions in place.

Figure 2:
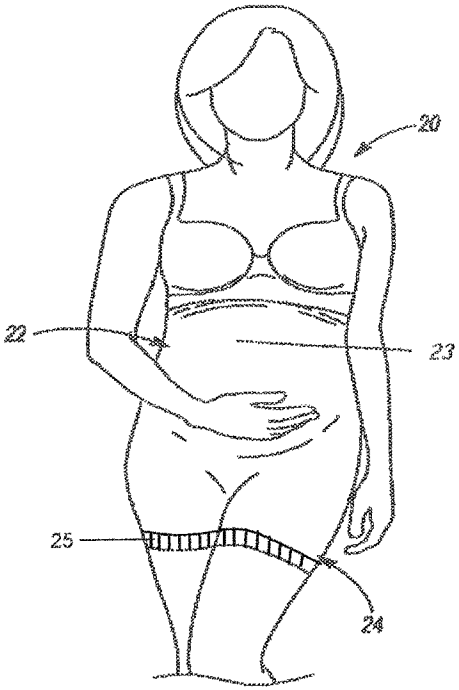
FIG. 2 illustrates a garment providing coverage to a person's belly, buttocks, hips, and thighs, according to exemplary embodiments of the present invention.

Referring now to the figures, FIG. 1 shows a person 20 wearing a garment 22 around her torso. The garment 22 includes a generally cylindrical band 23 and provides coverage of the torso of the person 20. The garment 22 is secured around the torso with a fastener 42, for example a plurality of hook and eye fasteners. FIG. 2 shows a frontal view of a person 20 wearing the garment 22 during pregnancy (though the teachings are not limited to pregnant women). The garment 22 provides coverage, slight compression, shaping, lifting, and/or smoothing of the torso by the band 23, and also provides the same for the thighs, hips, and/or buttocks through the base portion 24. In some embodiments, the garment 22 may have ribbing sections 25 at the base of the base portion 24 of the garment. 22. In some embodiments, the dimensions of the band 23 may be about 6 inches to about 30 inches in height, and more preferably about 9 inches to about 22 inches in height, wherein the height of the garment 22 is the distance between a point at the top edge of the garment 22 and the associated point directly below (e.g., in a vertical line) at the bottom edge of the band 23 of the garment, though additional length is also contemplated, especially for taller people. When stretched vertically, the height between any two points in a vertical line may increase by about 1.1× or more, about 1.25× or more, about 1.5× or more, about 2× or more, or even about 3× or more. The height may increase by about 10× or less, about 7× or less, about 5× or less, about 4× or less, or even about 3.5× or less.

Figure 3:
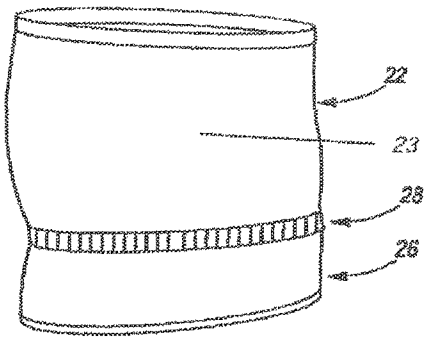
FIG. 3 illustrates a side view of a garment with a shirt extender feature, according to exemplary embodiment of the present invention.
Figure 4:
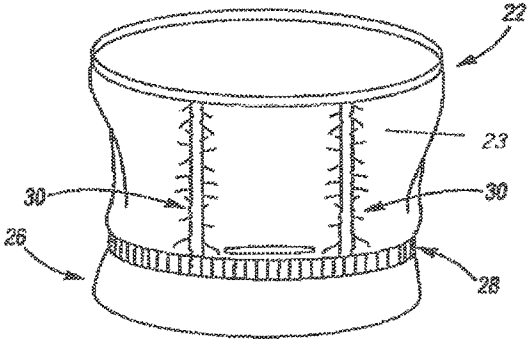
FIG. 4 illustrates a rear view of the garment of FIG. 3, according to exemplary embodiment of the present invention.
Figure 5:
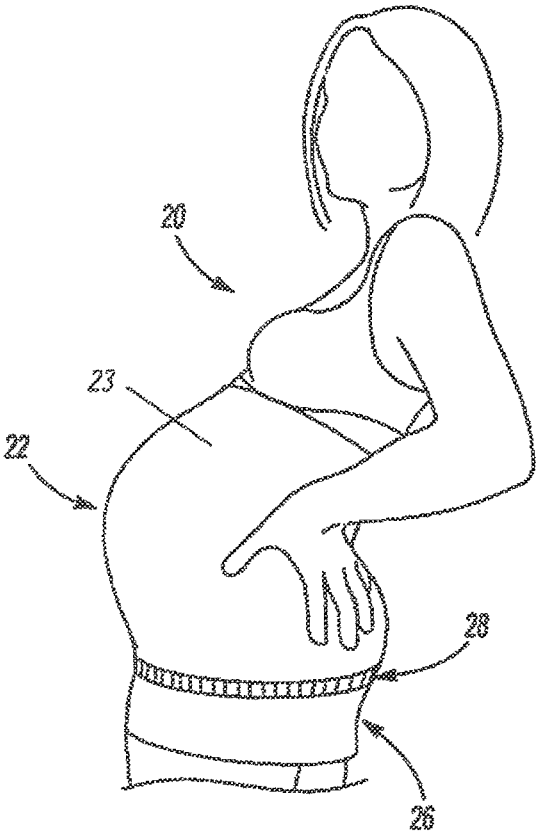
FIG. 5 illustrates a person with her belly being supported and/or lifted by a garment, according to exemplary embodiment of the present invention.
Figure 6:
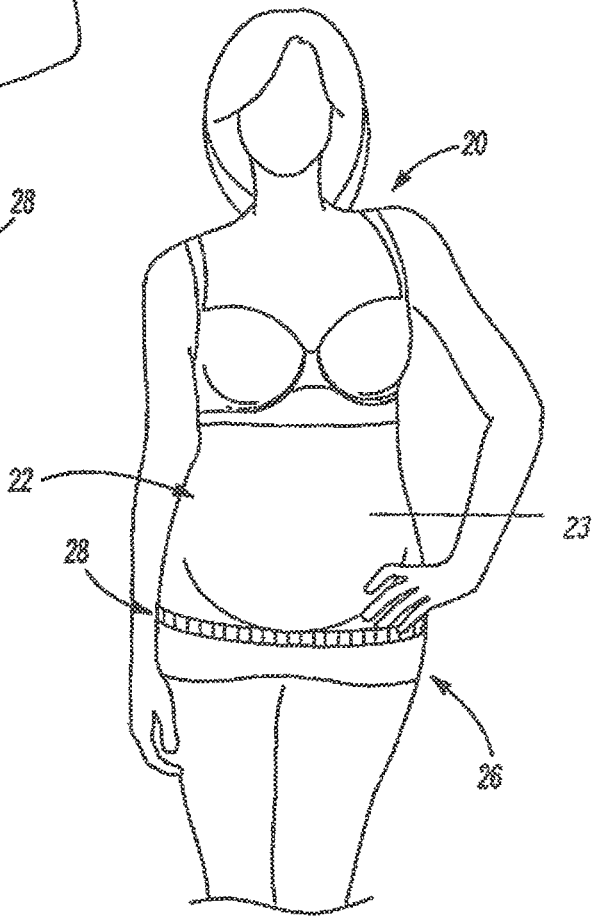
FIG. 6 illustrates a front view of a person wearing the garment of FIG. 5, according to exemplary embodiment of the present invention.

FIGS. 3 and 4 show a side and rear view, respectively, of the garment 22 with the band 23 worn around the torso and a shirt extender portion 26. The garment 22 also includes ribbing 28 at the base portion of of the garment 22. The rear view of the garment 22 in FIG. 4 also shows double ruching 30, which allows the garment 22 to expand vertically in the front (e.g., as the pregnant belly grows), while remaining lower on the back to provide comfort and support to the person. FIGS. 5 and 6 show a side view and a frontal view of a person 20 wearing the garment 22 as shown in FIGS. 3 and 4. The figures show the person 20 wearing a garment 22 with ruching 30 (see FIG. 4) in the band 23. The garment 22 is relatively confined to the lower back of the person 20, avoiding the upper back and underarm area. The ribbing 28 at the base portion of the garment 22 provides light lift and/or support underneath the protruding portion of the belly, which helps alleviate some of the discomfort caused by the belly being pulled downward due to the weight and/or as it grows. The garment extender portion 26 provides additional length and coverage to avoid exposed skin in the event that the person's shirt lifts.

Figure 7:
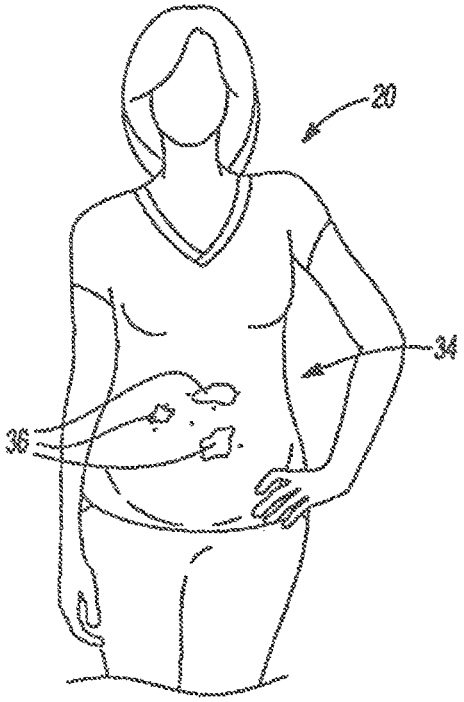
FIG. 7 illustrates a person wearing a garment with stains caused by the dissipation and transfer of skin products from the skin to the garment.

FIG. 7 shows the problem with applying skin products without the garment as disclosed herein. The person 20 is wearing a garment 34, such as a shirt or blouse, with stains 36 caused by skin products coming into contact with and being absorbed by the traditional top 34. The garment acts as a barrier, confining any skin products to the skin and reducing dissipation of the skin products, thereby ensuring the intended efficacy of the products, extending the life of the potentially expensive products, reducing the need to reapply skin products, and protecting the garments from potential deterioration or discoloration caused by ingredients used in these skin products.

Figure 8:
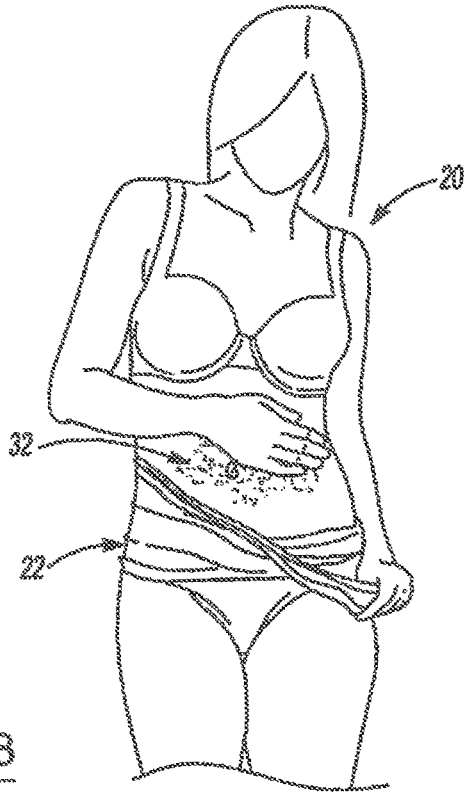
FIG. 8 illustrates a person applying a skin product prior to wearing a garment, according to exemplary embodiment of the present invention.

FIG. 8 shows how a person 20 may apply specialty skin products 32 to his or her skin prior to covering his or her torso with the garment 22. This figure shows the garment 22 covering a portion of the person's hips. The garment may provide coverage of the hips and buttocks and upper thigh region before it has been pulled up to cover the woman's belly portion. The wearer can step into the center of the garment and pull the generally cylindrical garment up over his or her legs, buttocks, and hips to cover his or her belly. It is also contemplated that the wearer can pull the garment over his or her head and shoulders and down his or her body to cover his or her belly. With a garment including a base portion (resembling e.g., shorts as shown in FIG. 2), a wearer can step with one foot into each opening and pull the garment up over his or her legs, buttocks, hips, and belly. The teachings also include a garment that can be wrapped around the person's torso and secured with any attachment mechanisms (e.g., Velcro, clips, snaps, buttons, zippers, hook and eye fasteners, and the like).

Figure 9:
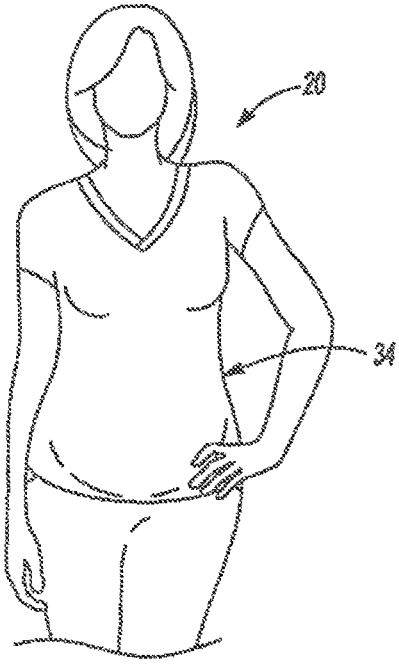
FIG. 9 illustrates a person wearing a garment without stains, showing the moisture locking feature of a garment, according to exemplary embodiment of the present invention.
Figure 10:
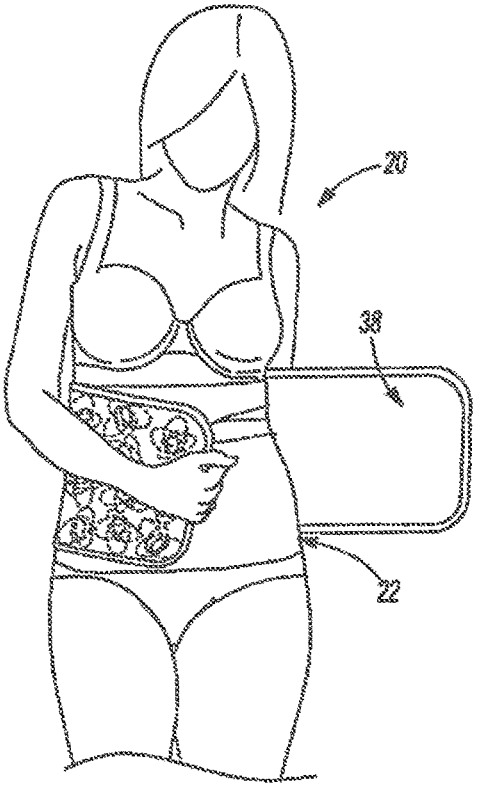
FIG. 10 illustrates a person, wearing a garment underneath another garment, according to exemplary embodiment of the present invention.

FIG. 9 shows a person 20 wearing a garment, such as conventional top, 34 without stains, illustrating a benefit to utilizing the present teachings underneath clothing. As shown in FIG. 10, the garment 22 can also be worn underneath a garment 38, such as a Belly Bandit® wrap product or other products from Belly Bandit®, to protect the garment from stains and deterioration and provide additional comfort to the person 20.

Figure 11:
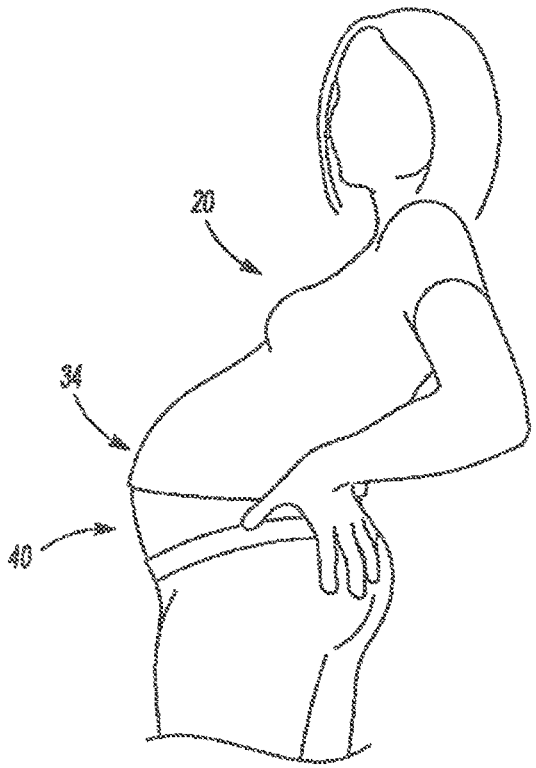
FIG. 11 illustrates a person wearing garments and exposing skin between a bottom of a garment and a waistband of another garment.
Figure 12:
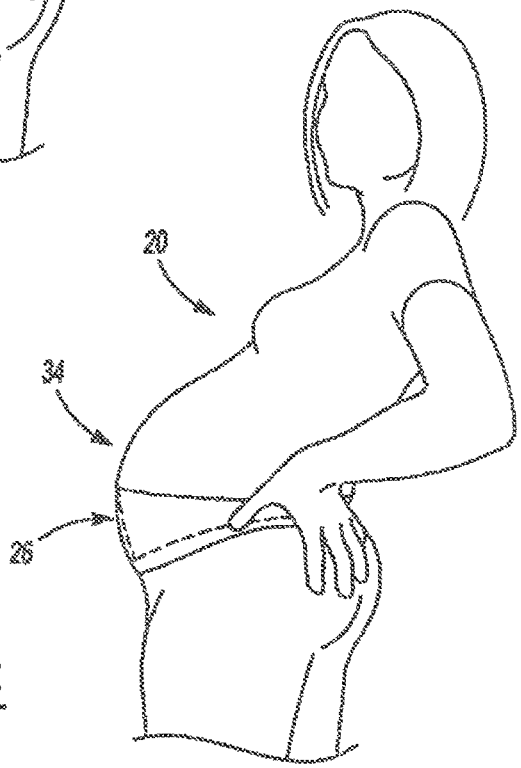
FIG. 12 illustrates a person wearing a garment over another garment worn on the bottom half of a torso of a wearer, as disclosed in exemplary embodiments of the present invention.

FIG. 11 shows a problem with a garment 34, such as a blouse or shirt. When the garment 34 is worn by a person 20, the size of the belly and/or movements by the person can lift the garment 34, exposing skin 40 between the base portion of the garment 34 and the waistband of another garment, such as pants or a skirt. FIG. 12 shows the improvement effect of a person 20 wearing a garment 34, such as a blouse or shirt, with the shirt extender portion 26 of the garment 34 reducing or eliminating the risk of exposed skin and overlapping the waistband of another garment.

Figure 14B:
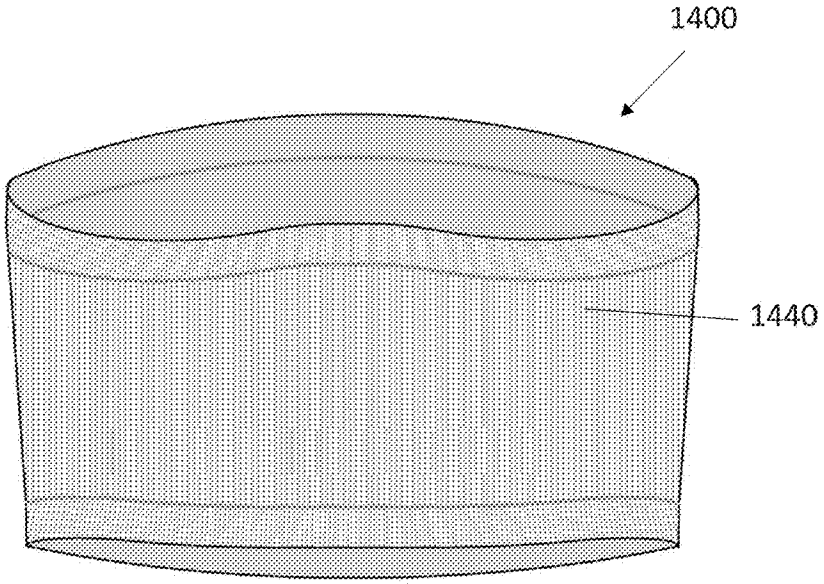
FIGS. 14A and 14B illustrate the front view and a back view of a garment, respectively, according to exemplary embodiment of the present invention.
Figure 14A:
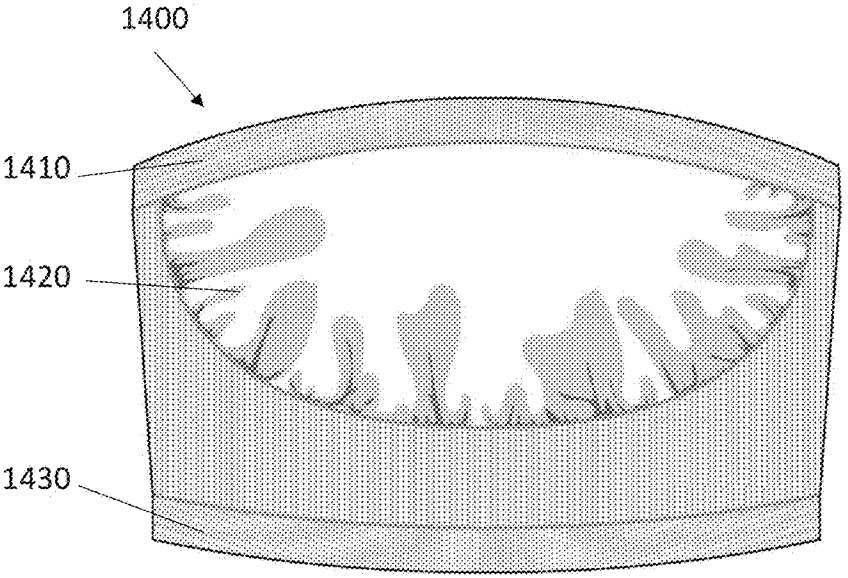

FIGS. 14A-14B show a garment 1400 with upper portion 1410 and base portion 1430. The garment 1400 may have a stretchable and/or compressive portion 1420 that may change size with varying size of the wearer's belly. The garment 1400 may have ribbing section 1440 extending from the upper portion to the base portion. The garment 1400 may have ribbing section 1440 extending 360 degrees around the garment 1400. The garment 1400 may also, in some embodiments, not have any ribbing section 1440 or have portions of ribbing sections 1440 in various parts of the garment 1400, such as the front, side, or back portion of the garment 1400. In some embodiments, the ribbing section 1440 may be replaced by other stretchable and/or compressive fabrics that provide support, lift, or compression to the wearer's body parts.

Figure 15B:
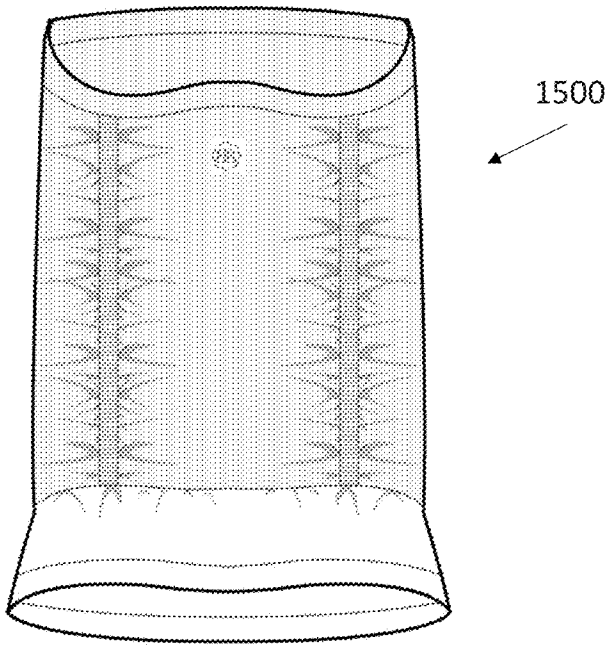
FIGS. 15A and 15B illustrate the front view and a back view of a garment, respectively, according to exemplary embodiment of the present invention.
Figure 15A:
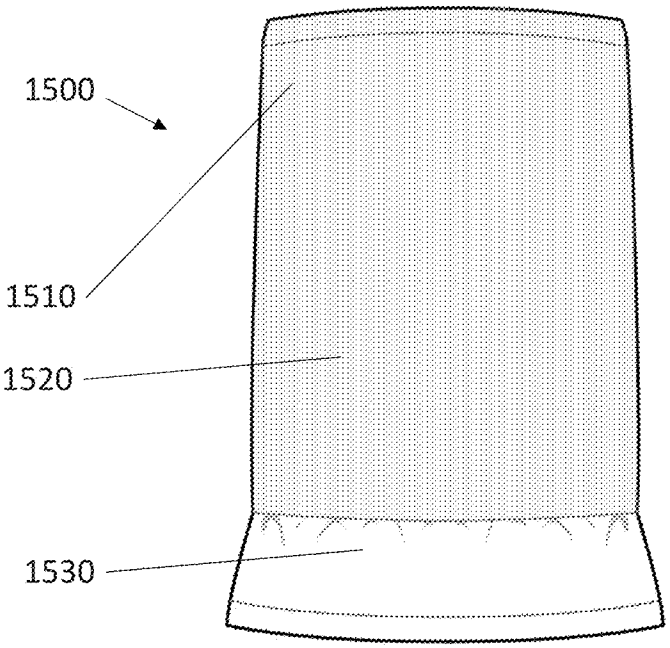
Figure 16C:
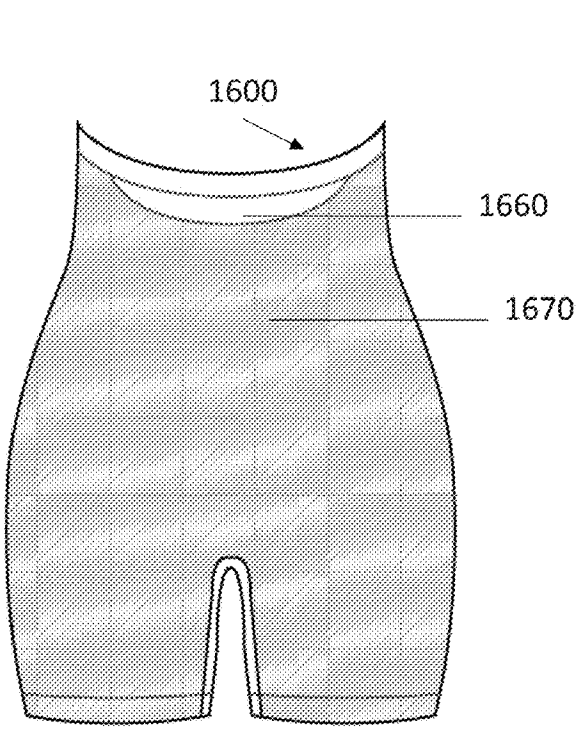
FIGS. 16A, 16B, and 16C illustrate the front view, side view, and a back view of a garment, respectively, according to exemplary embodiment of the present invention.
Figure 16B:
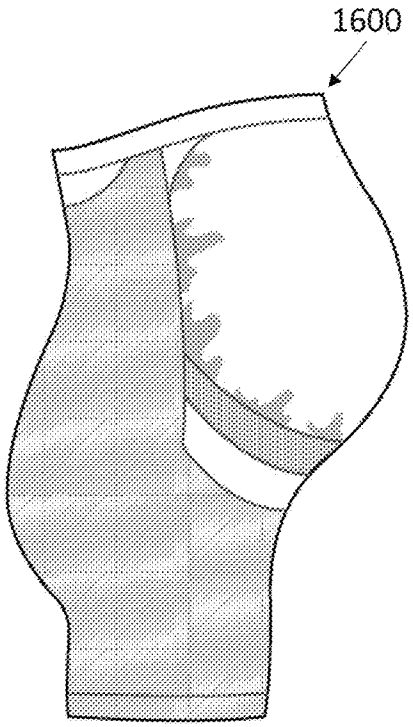

FIGS. 15A-15B shows a garment 1500 with upper portion 1510 and base portion 1530. The garment 1500 may have a ribbing section 1520 that may change in size with varying size of the wearer's belly. The ribbing section 1520 may be made of any stretchable and/or compressive fabric. The garment 1500 may have ribbing section 1530 extending from the upper portion to the base portion. The garment 1500 may have ribbing section 1530 extending 360 degrees around the garment 1500. The garment 1500 may also, in some embodiments, not have any ribbing section 15300 or have portions of ribbing sections 15300 in various portions of the garment 1500, such as the front, side, or back portion of the garment 1500. In some embodiments, the ribbing section 1530 may be replaced by other stretchable and/or compressive fabrics that provide support, lift, or compression to the wearer's body parts. In some embodiments, the garment 1500 may have a combination of ribbing section 1530 and other stretchable and/or other compressive fabrics, as shown in FIGS. 16A-16C.

Figure 16A:
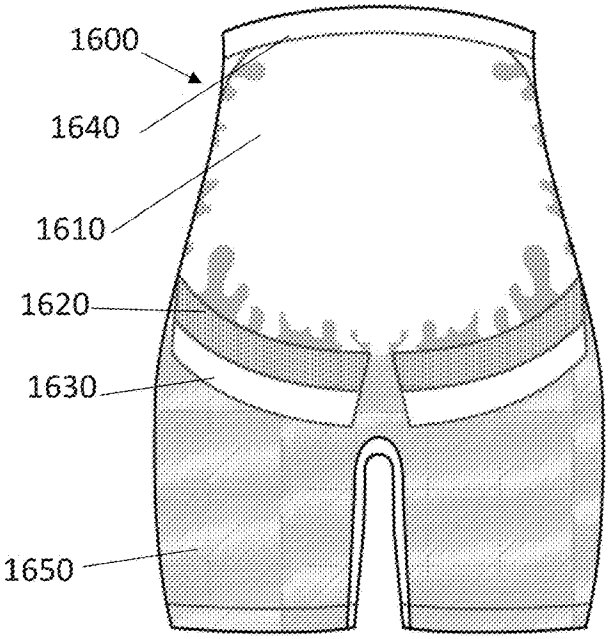

As illustrated in FIG. 16A, the garment 1600 may have an upper portion 1640 and a base portion 1650. It may also have portions of stretchable and/or compressive fabrics such as 1610, 1630, and 1660 in various portions of the garment 1600 and also ribbing sections 1620 and 1670. The ribbing sections 1620 and 1670 may be made of different materials with different stretchable and/or compressive levels. In some embodiments, the ribbing sections 1620 and 1670 may be replaced by other stretchable and/or compressive materials that provide support, lift, and/or compression to the wearer's body parts.

Figure 17C:
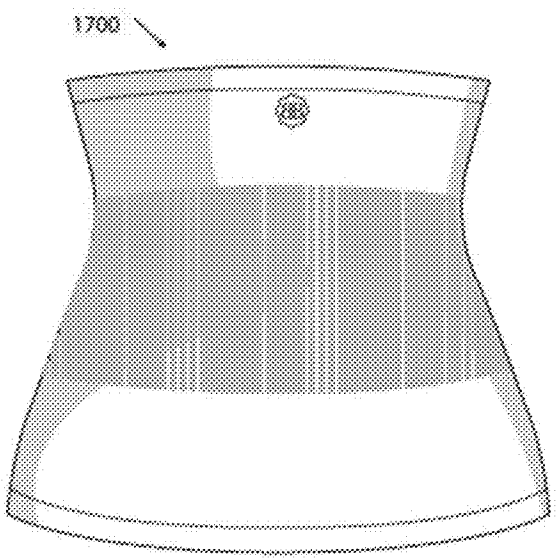
FIGS. 17A, 17B, and 17C illustrate the front view, side view, and a back view of a garment, respectively, according to exemplary embodiment of the present invention.
Figure 17B:
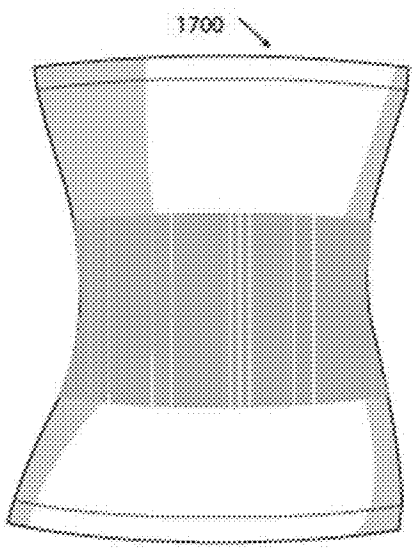
Figure 17A:
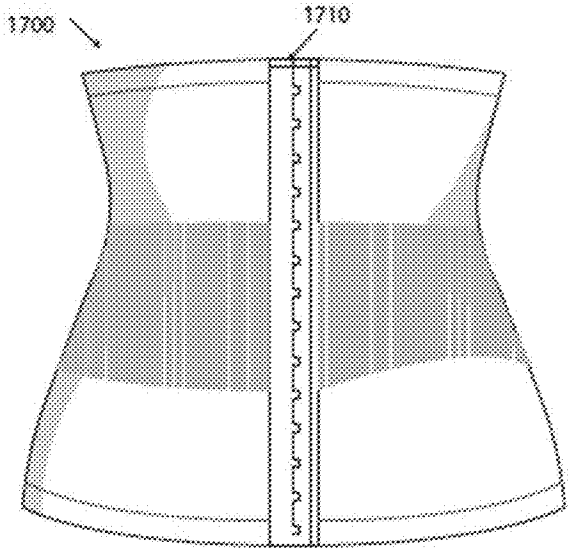

FIGS. 17A-17C show a garment 1700 that may be worn underneath or above other garments or just by itself. The garment 1700 may be made of materials that may help protect and hydrate a wearer's skin. It may also have moisture wicking and/or moisture locking material that may help keep lotions and creams on the skin of the wearer and off his or her clothes to help fight stretch marks and soothe dry, itchy pregnancy skin. The garment 1700 may also provide protective qualities after C-section procedures that women have undergone, by protecting the wearer's incision and preventing abrasive rubbing or chafing.

Figures 18A, 18B, 18C:
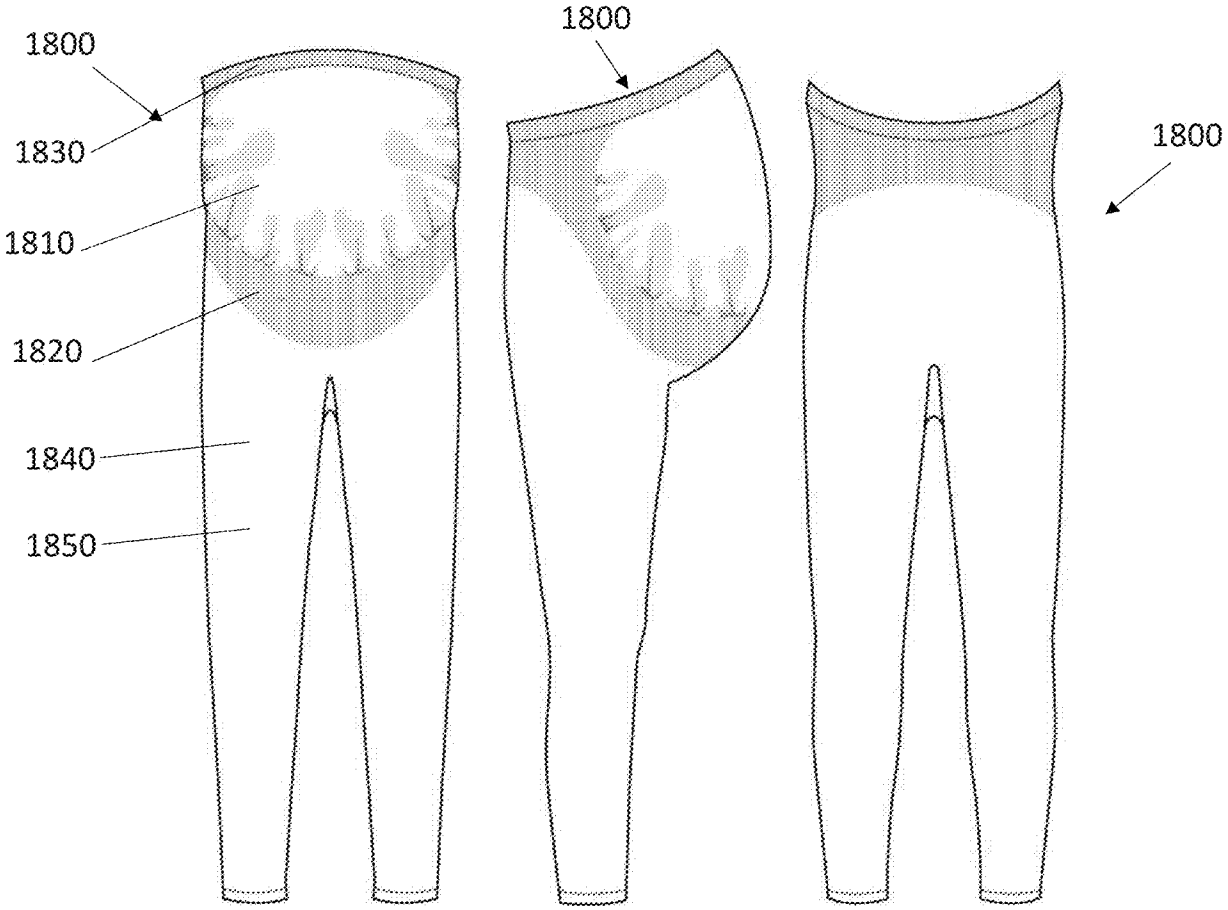
FIGS. 18A, 18B, and 18C illustrate the front view, side view, and a back view of a garment, respectively, according to exemplary embodiment of the present invention.

FIGS. 18A-18C show a garment 1800 with an upper portion 1830 and a base portion 1840. It may also have portions of stretchable and/or compressive fabrics such as 1810 and 1850 in various portions of the garment 1800 and also ribbing sections 1820. The ribbing sections 1820 may be made of different materials with different stretchable and/or compressive levels. In some embodiments, the ribbing sections 1820 may be replaced by other stretchable and/or compressive fabrics that provide support, lift, and/or compression to the wearer's body parts.

Figure 19B:
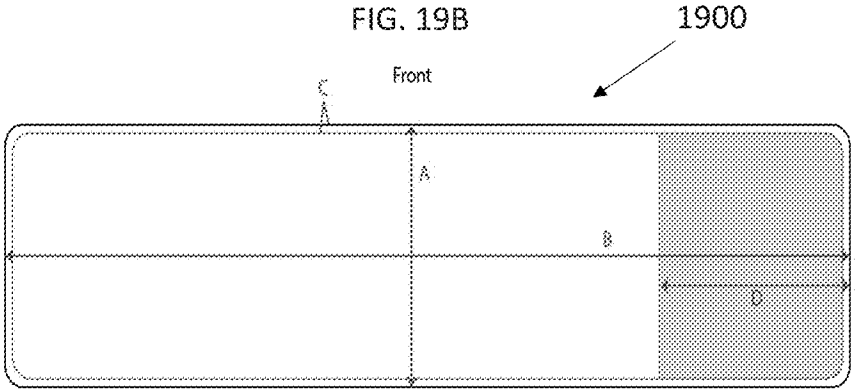
FIGS. 19A, 19B, and 19C illustrate the front view, top view, and a bottom view of a garment, respectively, according to exemplary embodiment of the present invention.
Figure 19C:
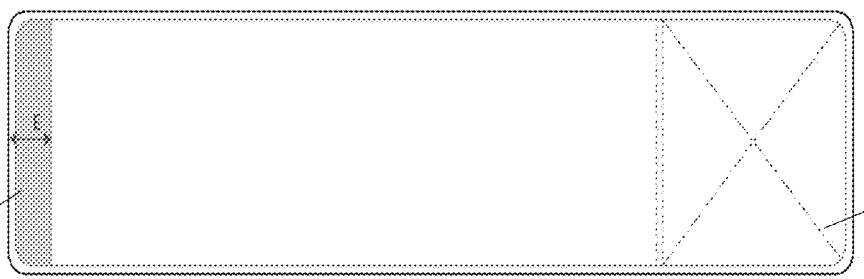
Figure 19A:
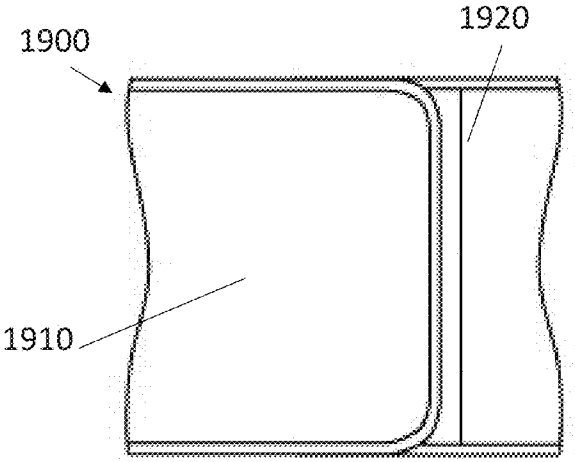
Figure 20C:
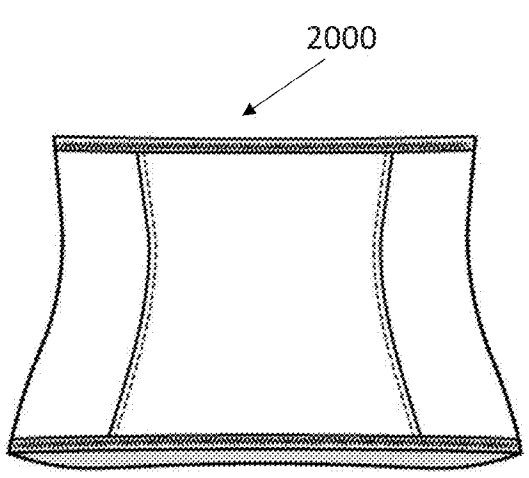
FIGS. 20A, 20B, and 20C illustrate the front view, side view, and a back view of a garment, respectively, according to exemplary embodiment of the present invention.
Figure 20B:
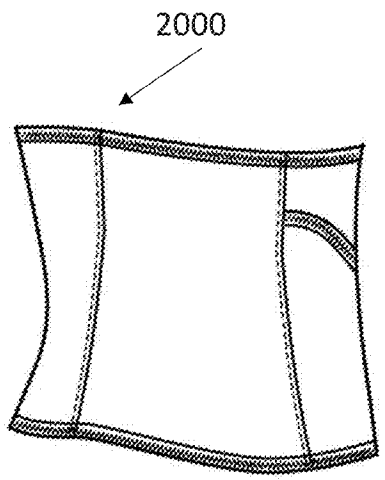
Figure 20A:
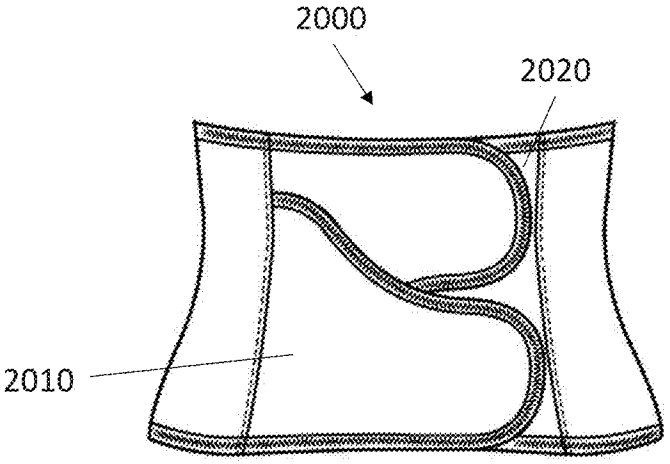

FIGS. 19A-19C show a garment 1900 with a beginning portion 1910 and an end portion 1920 that may be worn underneath or above other garments or just by itself. The beginning portion 1910 and end portion 1920 may have attachment means by which they can be attached to each other, such as Velcro, zippers, buttons, snaps, etc. In some embodiments, the garment may have a beginning portion 2010 and an end portion 2020 as illustrated in garment 2000 shown in FIGS. 20A-20C.

Figure 21C:
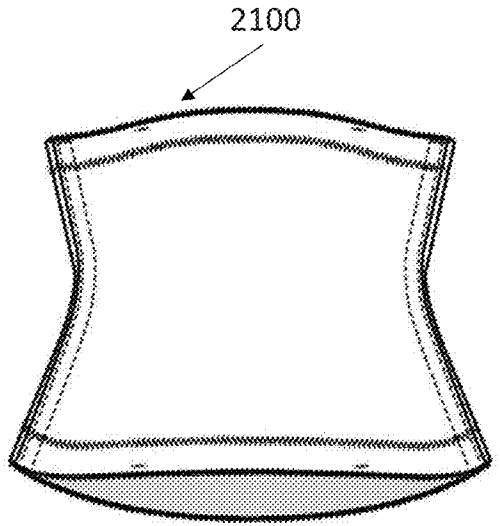
FIGS. 21A, 21B, and 21C illustrate the front view, side view, and a back view of a garment, respectively, according to exemplary embodiment of the present invention.
Figure 21B:
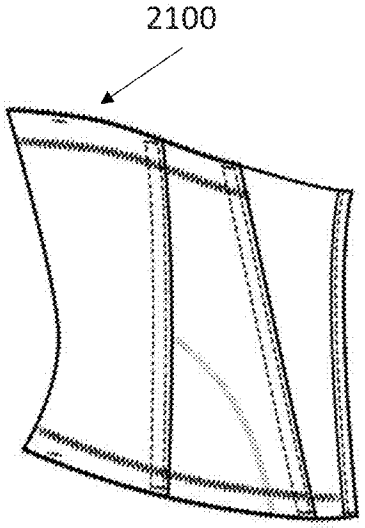
Figure 21A:
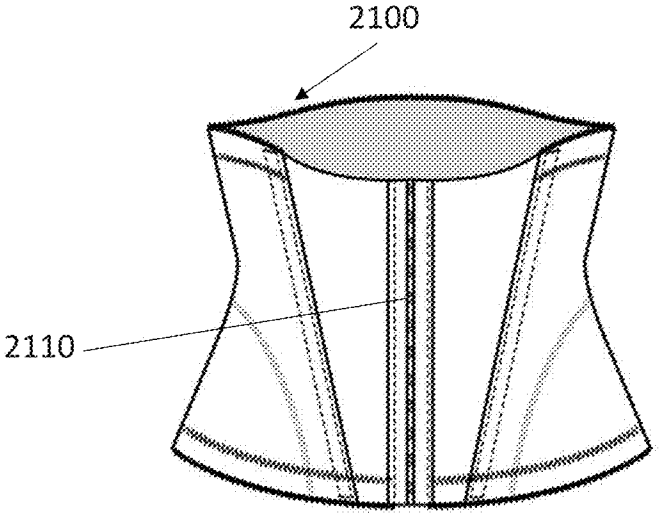
Figure 22C:
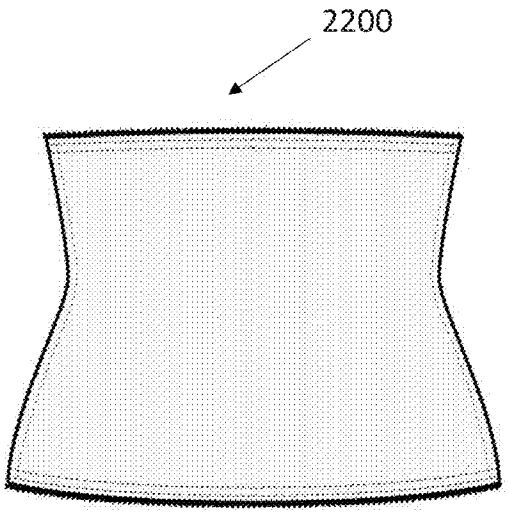
FIGS. 22A, 22B, and 22C illustrate the front view, side view, and a back view of a garment, respectively, according to exemplary embodiment of the present invention.
Figure 22B:
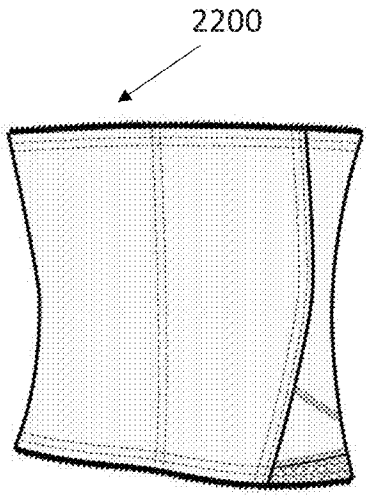
Figure 22A:
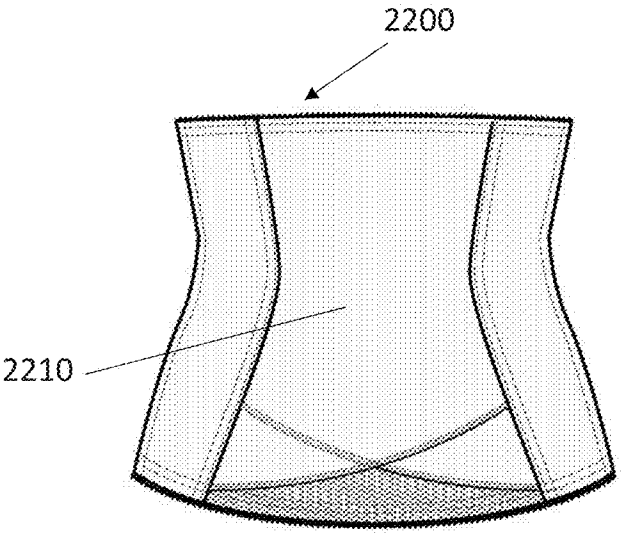
Figures 23A, 23B, 23C:
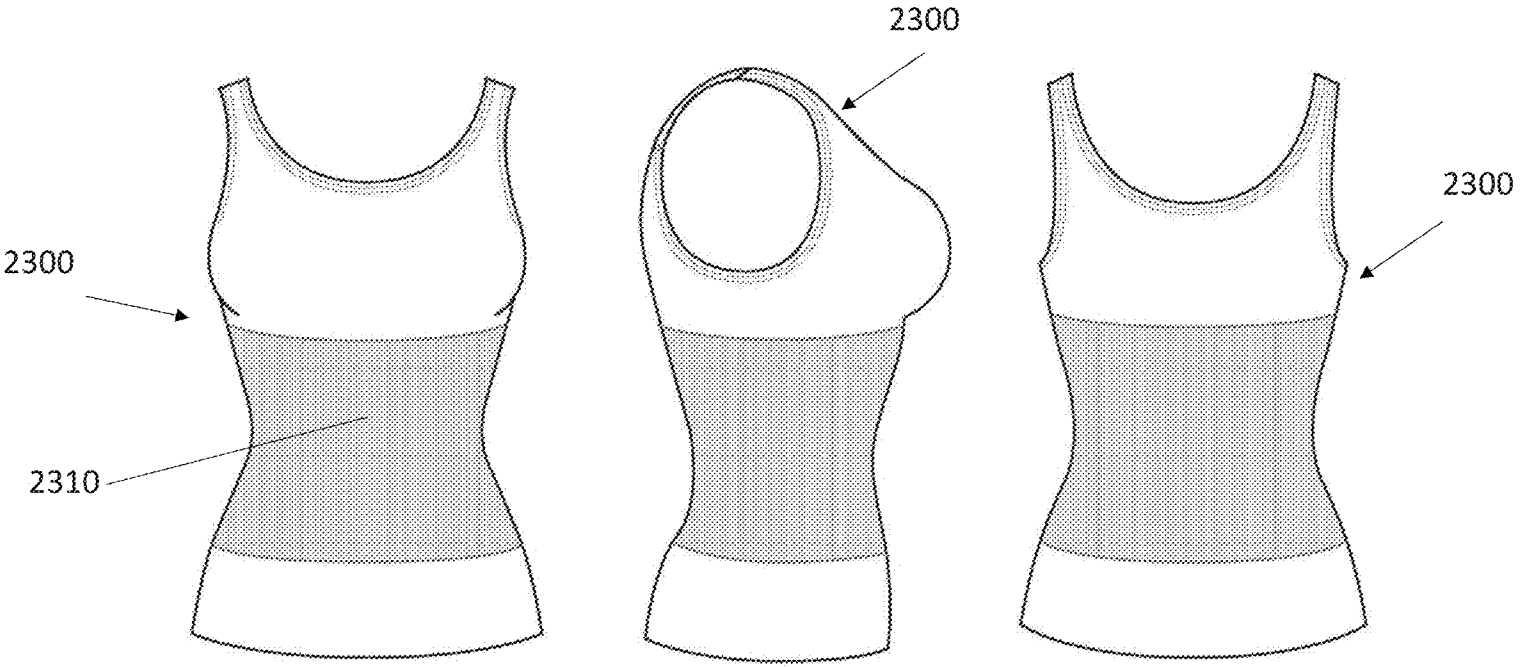
FIGS. 23A, 23B, and 23C illustrate the front view, side view, and a back view of a garment, respectively, according to exemplary embodiment of the present invention.
Figure 24C:
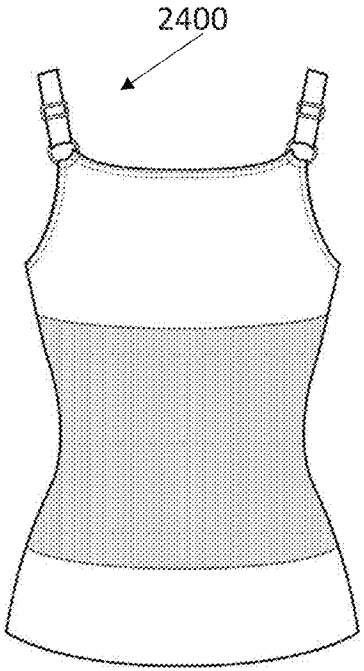
FIGS. 24A, 24B, and 24C illustrate the front view, side view, and a back view of a garment, respectively, according to exemplary embodiment of the present invention.
Figure 24B:
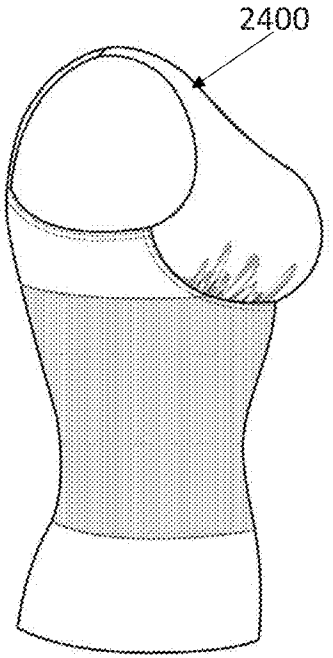
Figure 24A:
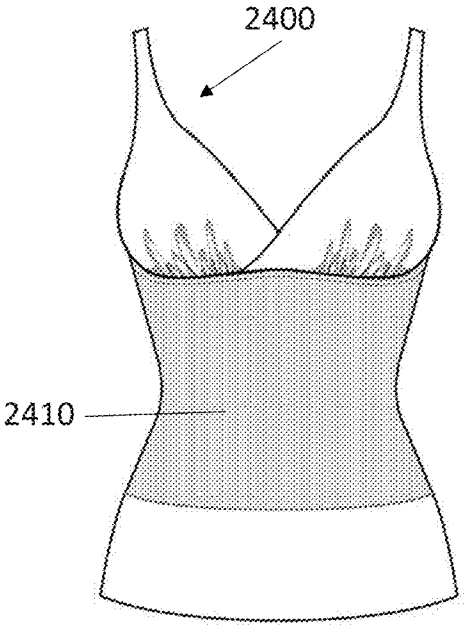
Figures 25A, 25B, 25C:
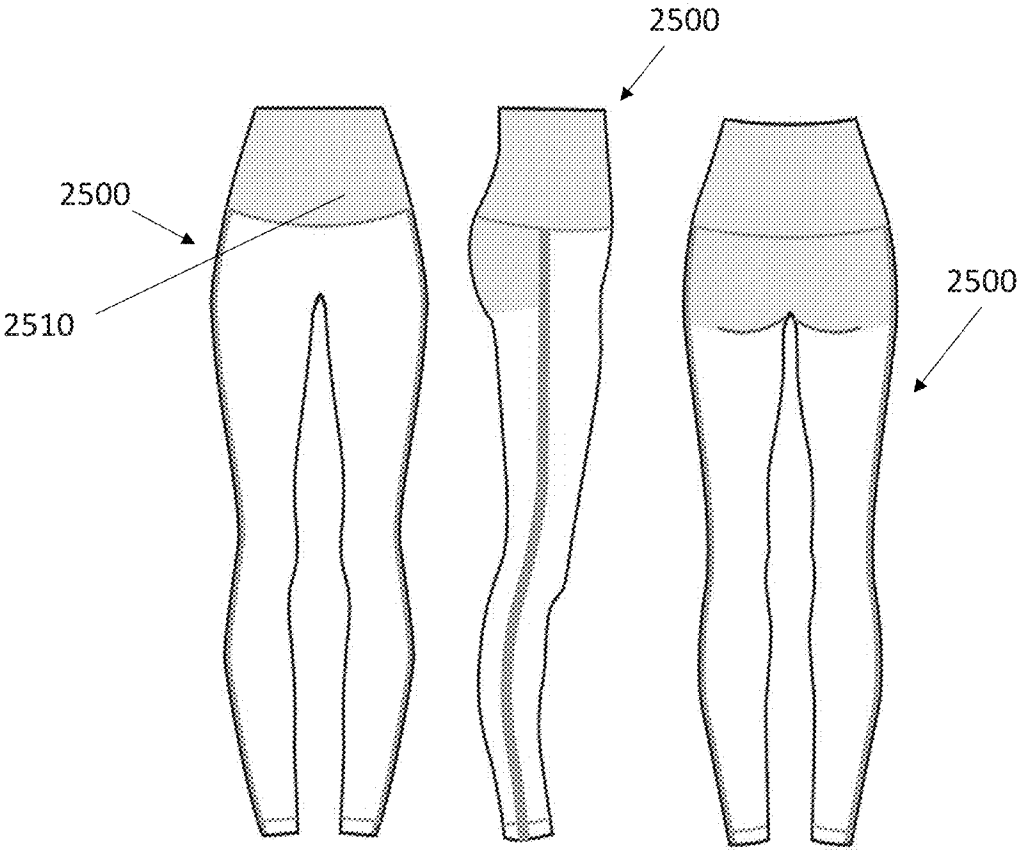
FIGS. 25A, 25B, and 25C illustrate the front view, side view, and a back view of a garment, respectively, according to exemplary embodiment of the present invention.

FIG. 21 shows a garment 2100 that may resemble a corset. The garment 2100 may have compressive features that work to slim the wearer's waist and tummy while concealing any bothersome back bulge. The garment 2100 may have soft boning features that may ensures that the garment 211 will stay in place without rolling or digging. It may also be made of a lightweight and breathable fabric-for maximum comfort. The garment 2100 may have any attachment means to attach its two ends together. For example, it may have a 6-hook design that may allow for greater adjustability and compression. In some embodiments, the garment 2100 may have multiple stretchable and/or compression fabrics with varying elastic and/or compression levels. For example, some or all portions of the garment 2100 may have a double layered compression using multiple pieces of fabric. The garment 2100 may be made of any materials described herein, including any convention materials used in undergarments, such as cotton, lace, etc. In some embodiments, the garment may resemble garment 2200 as illustrated in FIGS. 22A-22C that may embody any feature of garment 2100 and/or garment 1700.

FIGS. 23A-23C and FIGS. 24A-24C illustrate garments 2300 and 2400, respectively. The garments 2300 and 2400 may have stretchable and/or compressive portions 2310 and 2410. The stretchable and/or compressive portions 2310 and 2410 may be located such that they extend from the upper portion to the base portion. For example, the stretchable and/or compressive portions 2310 and 2410 may be located at a portion below a woman's breasts on the garment 2300 and 2400. In other embodiments, the stretchable and/or compressive features 2310 and 2410 may be located at any and/or various locations on the garment 2300 and 2400.

Also, shown in FIGS. 27A-27B and 29A-29C are garments 2700 and 2900 with stretchable and/or compressive portions 2710 and 2910.

FIGS. 25A-25C and 30A-30C show a garment 2500 and 3000, respectively, with stretchable and/or compression portions 2510, 3010. In some embodiments, the stretchable and/or compression features 2510, 3010 may extend throughout the garment 2500 or 3000. In other embodiments, the stretchable and/or compression portions 2510, 3010 may be present in select areas in the front, side, and/or back portion of the garment 2510, 3010. The stretchable and/or compression portions 2510, 3010 may be present in a portion of the garment 2500 or 3000 covering the belly portion of the wearer and/or the buttock portion.

Figure 26C:
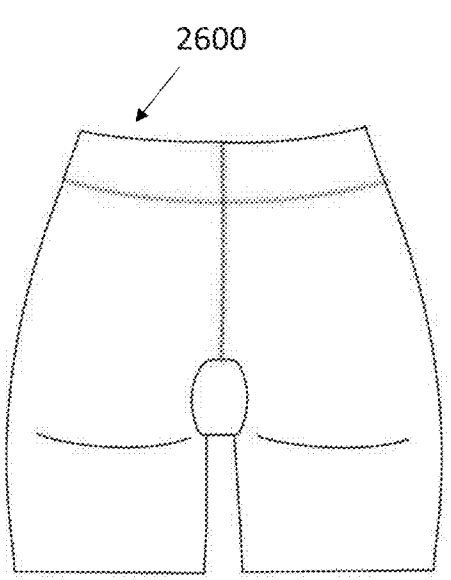
FIGS. 26A, 26B, and 26C illustrate the front view, side view, and a back view of a garment, respectively, according to exemplary embodiment of the present invention.
Figure 26B:
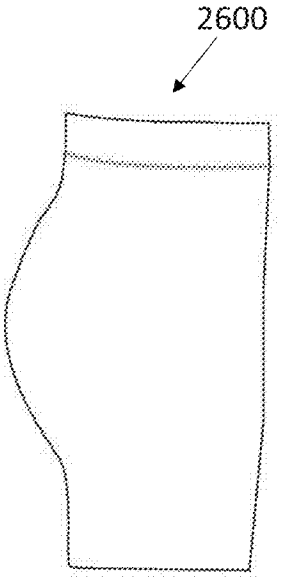
Figure 26A:
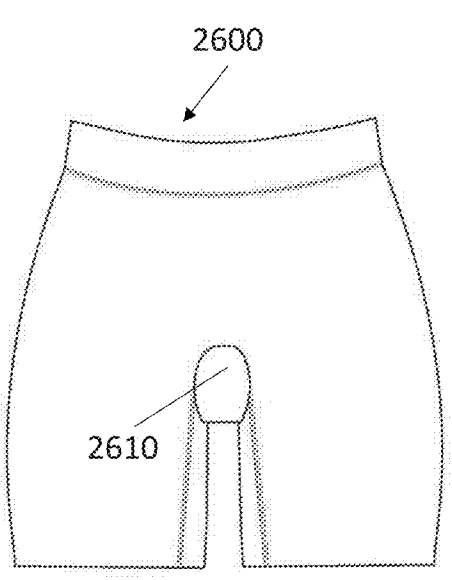
Figure 27B:
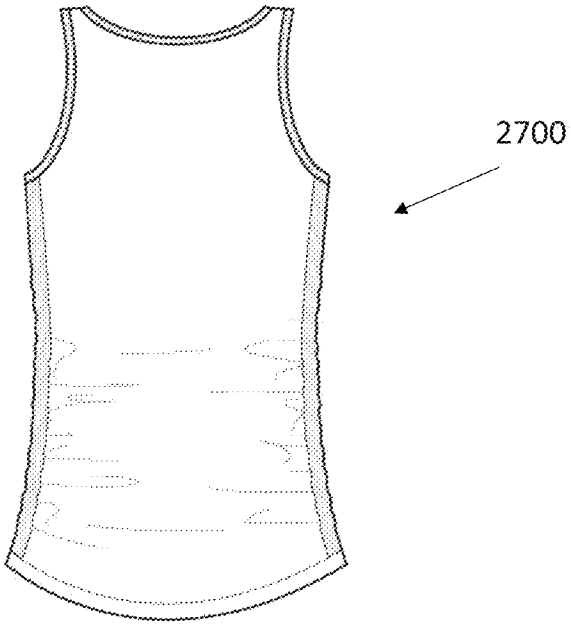
FIGS. 27A and 27B illustrate the front view and a back view of a garment, respectively, according to exemplary embodiment of the present invention.
Figure 27A:
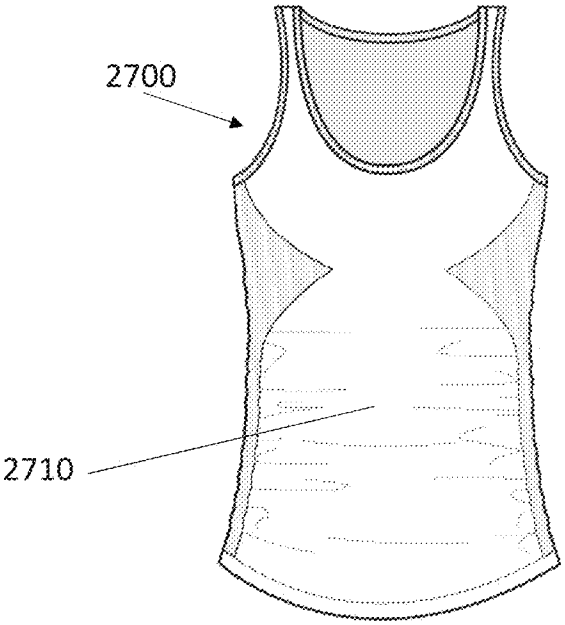

FIGS. 26A-26C shows a garment 2600 that may sit snugly on a wearer's body preventing rolling, pinching or pulling. It may have a 360° of targeted compression for the belly, buttocks, and thighs. It may have a clean-cut leg finish.

Figures 28A, 28B, 28C:
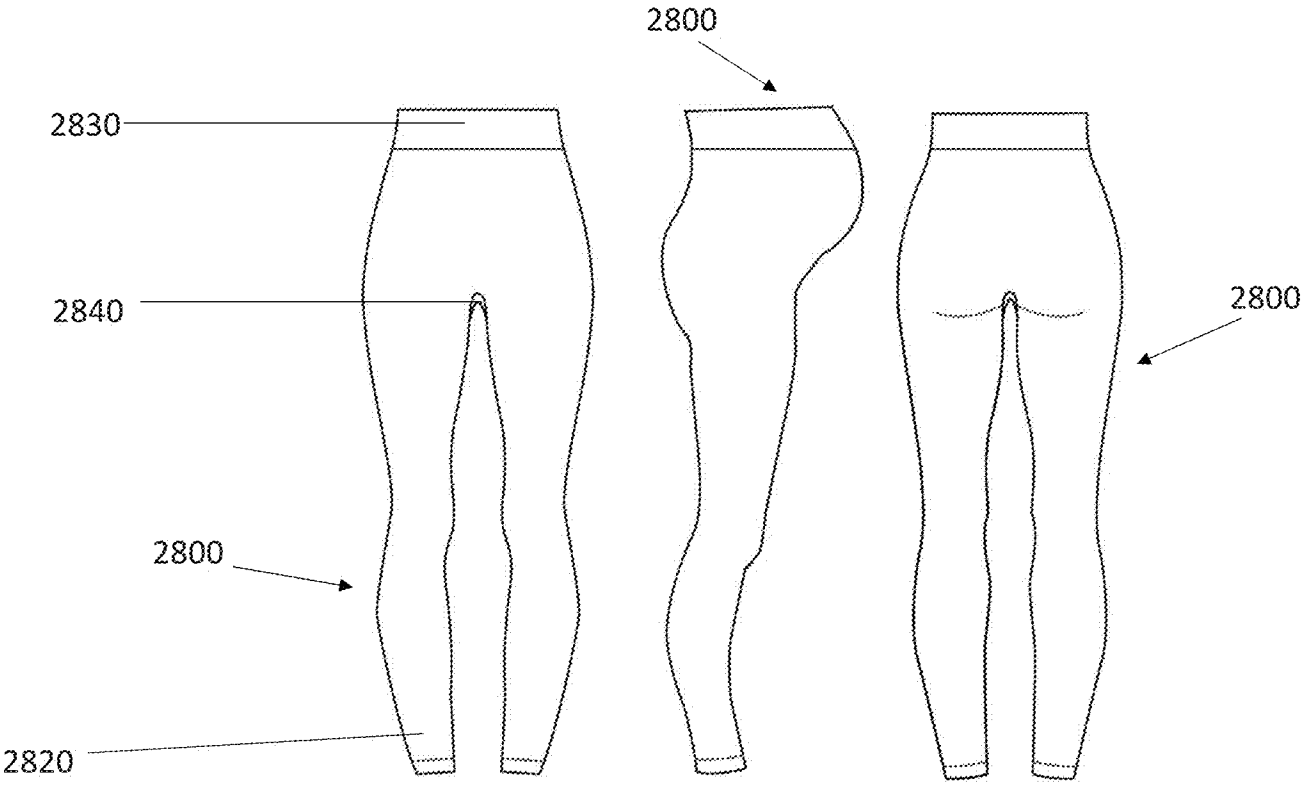
FIGS. 28A, 28B, and 28C illustrate the front view, side view, and a back view of a garment, respectively, according to exemplary embodiment of the present invention.
Figure 29C:
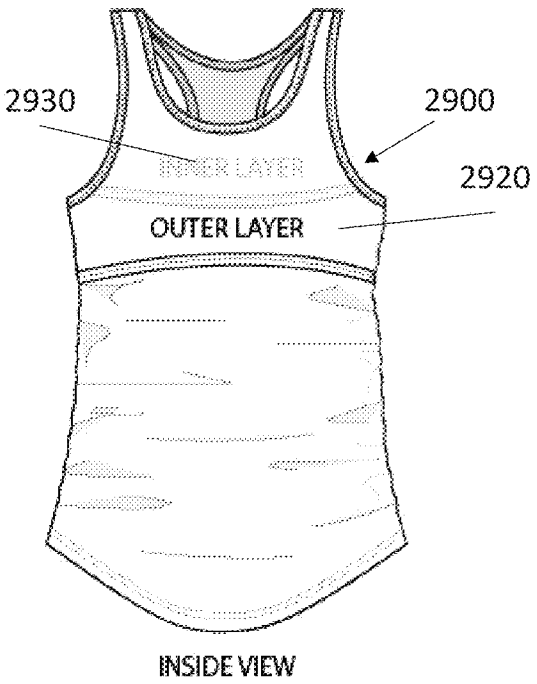
FIGS. 29A, 29B, and 29C illustrate the front view, back view, and a layered front view of a garment, respectively, according to exemplary embodiment of the present invention.
Figure 29B:
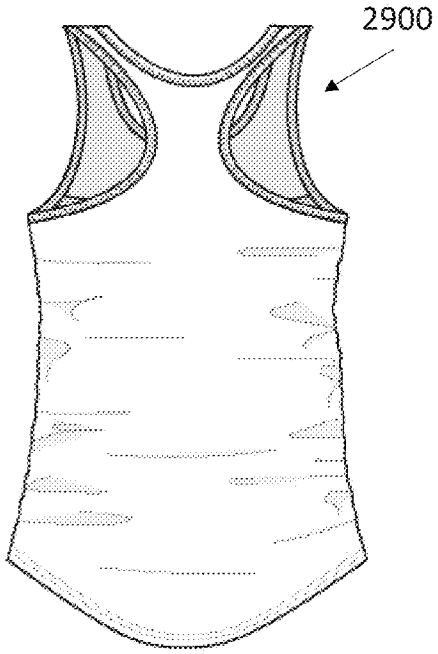
Figure 29A:
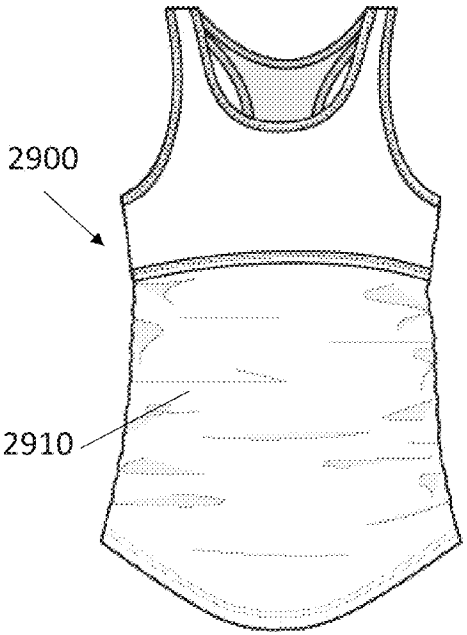
Figures 30A, 30B, 30C:
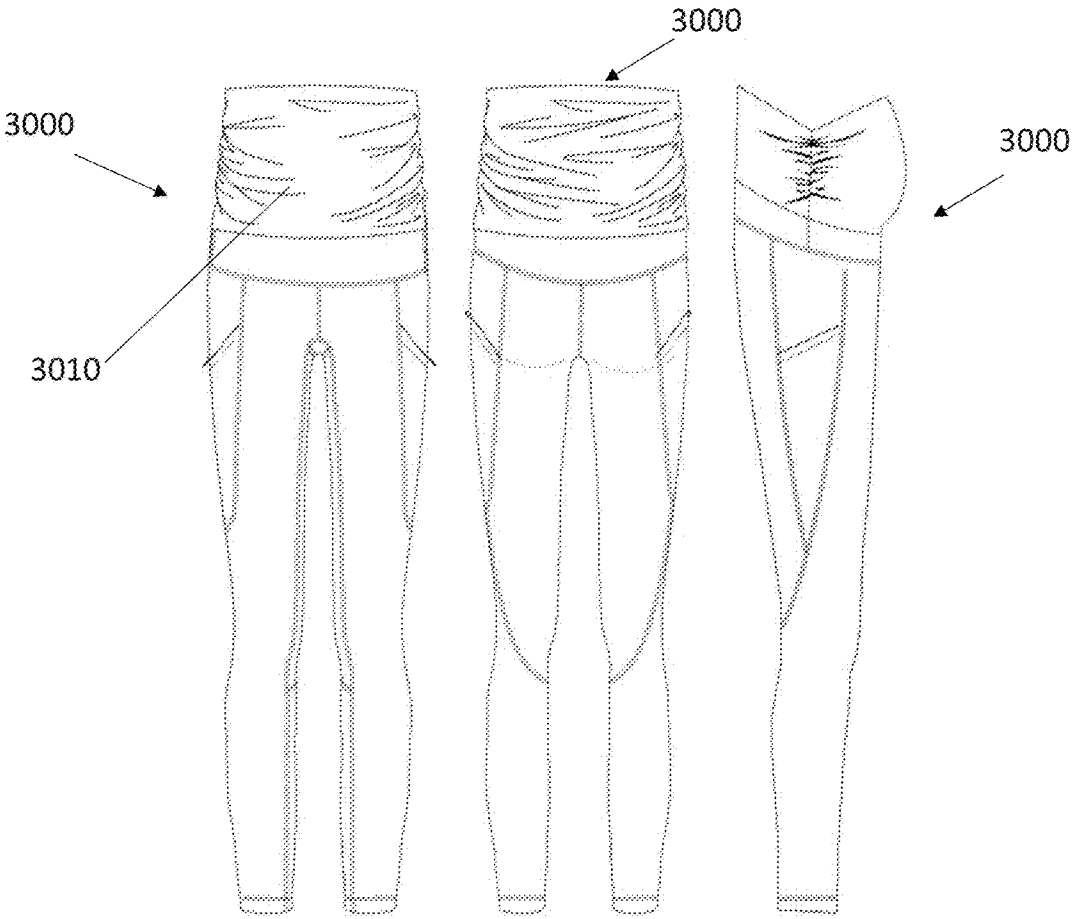
FIGS. 30A, 30B, and 30C illustrate the front view, back view, and a side view of a garment, respectively, according to exemplary embodiment of the present invention.

FIGS. 28A-28C illustrate a garment 2800 with an upper portion 2830 and base portion 2820. The upper portion may have a 1-inch turnback hem and the lower portion 2820 may have a 1-inch turnback leg opening hem. The garment 2800 may have a sown in gusset 2840. The gusset 2840 may be attached to the garment 2800 using any other attachment means.

Figure 31C:
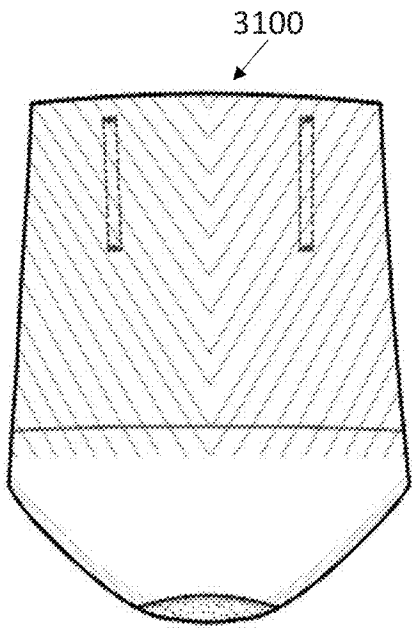
FIGS. 31A, 31B, and 31C illustrate the front view, side view, and a back view of a garment, respectively, according to exemplary embodiment of the present invention.
Figure 31B:
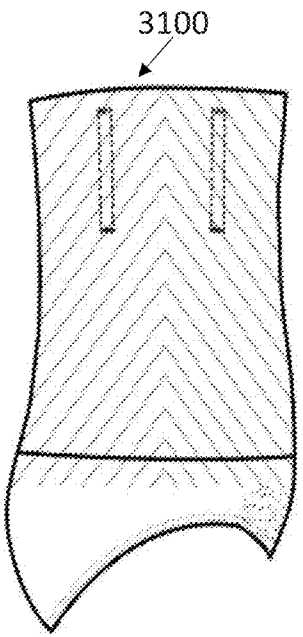
Figure 31A:
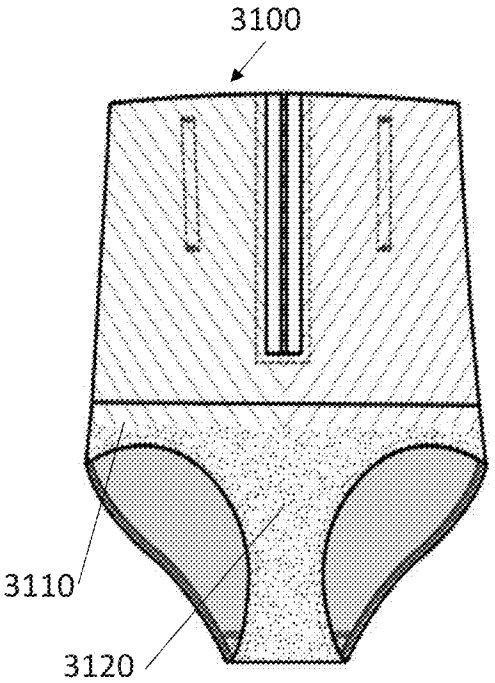

FIGS. 31A-31C shows a garment 3100 that may be worn after a C-section delivery or any other surgery in that area. The garment 3100 provides targeted compression to the affected area. The garment 3100 may help prevent swelling in the affected area and may also have silver-infused fibers in their fabric that can help eliminate bacteria, wetness, and odor The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims. While this disclosure is focused primarily on a pregnant woman's body, it is contemplated that this garment may also be used by persons who are not pregnant, men or women, who are looking for a garment to protect traditional garments from skin products, or one that said products cannot seep through, provide a shirt extension, provide support for the lower back and belly, or to provide additional smoothing, compression and shaping of belly, hips, thighs, and/or buttocks. Furthermore, the words man, woman, user, person, wearer, and variations of these words herein are meant to be synonymous and use of any of these words does not exclude the others unless otherwise stated.

As used herein, unless otherwise stated, the teachings envision that any member of a genus (list) may be excluded from the genus; and/or any member of a Markush grouping may be excluded from the grouping.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the of a range in terms of at "x" parts by weight of the resulting polymeric blend composition" also contemplates a teaching of ranges of same recited amount of "x" in percent by weight of the resulting polymeric blend composition.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for ail purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist of, or consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A maternity or postpartum support garment configured to cover at least a part of a front of a wearer's body, the maternity or postpartum support garment comprising:

one or more stretchable and/or compressive materials;

a generally cylindrical shaped upper portion;

a generally cylindrical shaped base portion;

at least one ribbing section located on at least one of the upper portion or the base portion, the at least one ribbing section comprising a plurality of vertical ribs, one or more horizontal ribs, or combinations thereof; and a first section configured to cover at least a part of a front of the wearer's body;

wherein the at least one ribbing section provides a first level of compression;

wherein the first section provides a second level of compression different from the first level of compression provided by the at least one ribbing section; and wherein the first section does not include any part of the at least one ribbing section.

2. The maternity or postpartum support garment of claim 1, further comprising at least one ruching section.

3. The maternity or postpartum support garment of claim 1, further comprising a second section, the second section providing a third level of compression different from the second level of compression provided by the first section and the first level of compression provided by the at least one ribbing section.

4. The maternity or postpartum support garment of claim 3, wherein the second section is configured to cover at least one of the front, a side, or a back of the wearer's body.

5. The maternity or postpartum support garment of claim 2, wherein the at least one ruching section is positioned on an edge of the at least one ribbing section.

6. The maternity or postpartum support garment of claim 5, wherein the at least one ruching section is positioned on an edge of the first section and the at least one ribbing section.

7. The maternity or postpartum support garment of claim 3, further comprising at least one ruching section, wherein the at least one ruching section is positioned on an edge of the first section and the second section.

8. The maternity or postpartum support garment of claim 1, wherein the garment further comprises a moisture locking material.

9. The maternity or postpartum support garment of claim 1, wherein at least one of the upper portion or the base portion is formed with a seam.

10. The maternity or postpartum support garment of claim 1, wherein the first section is configured to not extend to cover any part of a side or a back of the wearer's body.

11. The maternity or postpartum support garment of claim 3, wherein the second section is configured to not extend to cover any part of a side or a back of the wearer's body.

12. The maternity or postpartum support garment of claim 1, wherein the first section is configured to covers at least a part of a belly of the wearer.

13. The maternity or postpartum support garment of claim 12, wherein the first section is configured to change in dimensions along with the changes in dimensions of the belly of the wearer.

14. The maternity or postpartum support garment of claim 1, wherein the garment has at least one portion having a seam.

15. The maternity or postpartum support garment of claim 1, wherein the garment comprises a moisture wicking material.

16. The maternity or postpartum support garment of claim 1, wherein the garment comprises a fabric having quick drying capabilities.

17. The maternity or postpartum support garment of claim 1, wherein the at least one ribbing section is located on both an inside and an outside of the garment.

18. The maternity or postpartum support garment of claim 1, wherein the at least one ribbing section is configured to provide support to a belly of the wearer.

19. The maternity or postpartum support garment of claim 1, wherein the at least one ribbing section has at least two different heights at at least two different portions of the garment.

20. A method of providing support to a body part of a wearer, the method comprising the steps of:

providing a support garment, the support garment comprising:

one or more stretchable and/or compressive materials;

at least one generally cylindrical shaped upper portion;

at least one generally cylindrical shaped base portion;

at least one ribbing section comprising a plurality of vertical ribs, one or more horizontal ribs, or combinations thereof; and a first section configured to cover at least a body part of the wearer;

wherein the at least one ribbing section provides a first level of compression; and wherein the at first section provides a second level of compression different from the first level of compression provided by the at least one ribbing section; and wearing the support garment.

* * * * *